US007134257B2

(12) United States Patent
Focke et al.

(10) Patent No.: US 7,134,257 B2
(45) Date of Patent: Nov. 14, 2006

(54) METHOD AND DEVICE FOR PRODUCING HARD PACKS FOR CIGARETTES

(75) Inventors: Heinz Focke, deceased, late of Verden (DE); by Jürgen Focke, legal representatives, Verden (DE); Hans-Jürgen Bretthauer, Bremen (DE); Henry Buse, Visselhövede (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 10/496,292

(22) PCT Filed: Nov. 13, 2002

(86) PCT No.: PCT/EP02/12682

§ 371 (c)(1),
(2), (4) Date: May 21, 2004

(87) PCT Pub. No.: WO03/045383

PCT Pub. Date: Jun. 5, 2003

(65) Prior Publication Data

US 2004/0261368 A1 Dec. 30, 2004

(30) Foreign Application Priority Data

Nov. 30, 2001 (DE) ..... 101 58 736

(51) Int. Cl.
*B65B 19/22* (2006.01)
*B65B 11/58* (2006.01)

(52) U.S. Cl. ..... 53/234; 53/174; 53/449; 53/466; 53/575

(58) Field of Classification Search ..... 53/170, 53/174, 220, 225, 228, 234, 252, 253, 449, 53/466, 575, 576, 578, 579; 493/910
See application file for complete search history.

(56) References Cited

U.S. PATENT DOCUMENTS 3,735,767 A * 5/1973 Kruse et al. ..... 131/283
3,802,326 A 4/1974 Bardenhagen et al.
4,112,651 A * 9/1978 Bardenhagen et al. ..... 53/449
4,241,564 A * 12/1980 Quarenghi ..... 53/575
4,258,526 A 3/1981 Focke
4,428,177 A * 1/1984 Focke et al. ..... 53/170
4,581,004 A * 4/1986 Nagata ..... 493/164
5,121,585 A * 6/1992 Focke et al. ..... 53/136.1
5,979,140 A 11/1999 Bretthauer et al.
5,996,310 A * 12/1999 Bailey et al. ..... 53/228
6,023,909 A 2/2000 Boldrini
6,470,651 B1 * 10/2002 Polazzi et al. ..... 53/466

(Continued)

FOREIGN PATENT DOCUMENTS

DE 2 163 784 7/1973

(Continued)

*Primary Examiner*—Louis K. Huynh
*Assistant Examiner*—Thanh Truong
(74) *Attorney, Agent, or Firm*—Sughrue Mion, PLLC

(57) ABSTRACT

For producing hard packs, namely hinge-lid boxes or shell and slide packs in particular, inner and outer pack units are prepared separately in each case, namely a shell (20), on the one hand, and a blank for a hinge-lid box, on the other hand. The inner pack unit, comprising a cigarette block (10) and a further pack part, namely a slide (13) or a collar, is prepared in the region of a mandrel turret (24). The pack units are then brought together, with continued rotary movement, by axial displacement relative to one another.

16 Claims, 17 Drawing Sheets

Figure 2:
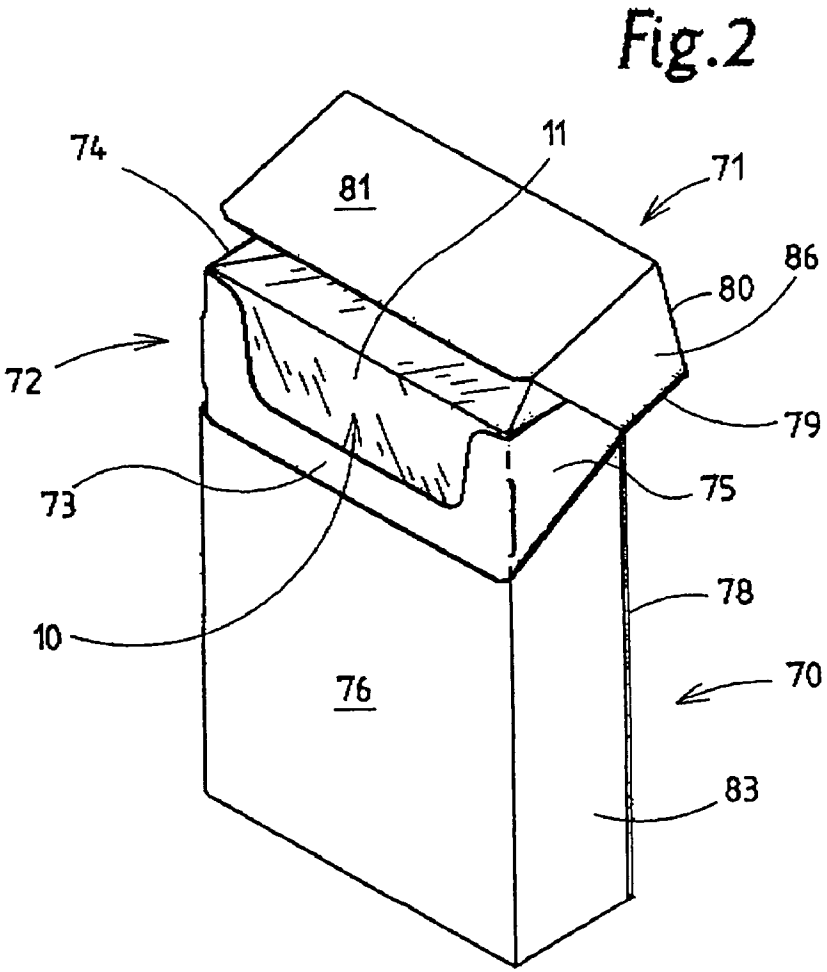

U.S. PATENT DOCUMENTS 6,612,094 B1 * 9/2003 Bailey et al. ..... 53/234

FOREIGN PATENT DOCUMENTS

| | | | |
|---|---|---|---|
| DE | 28 06 263 | C2 | 8/1986 |
| DE | 35 36 791 | A1 | 4/1987 |
| DE | 196 54 394 | A1 | 7/1998 |
| DE | 197 47 594 | A1 | 4/1999 |
| EP | 471 395 | A1 | 4/1992 |
| EP | 481 305 | A1 | 4/1992 |
| EP | 1 013 557 | A1 | 6/2000 |
| WO | WO 98/57852 | A2 | 12/1998 |

* cited by examiner

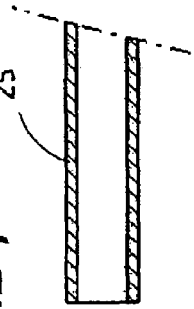
Fig.24
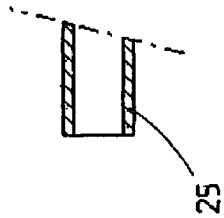
Fig.25
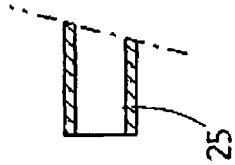
Fig.26
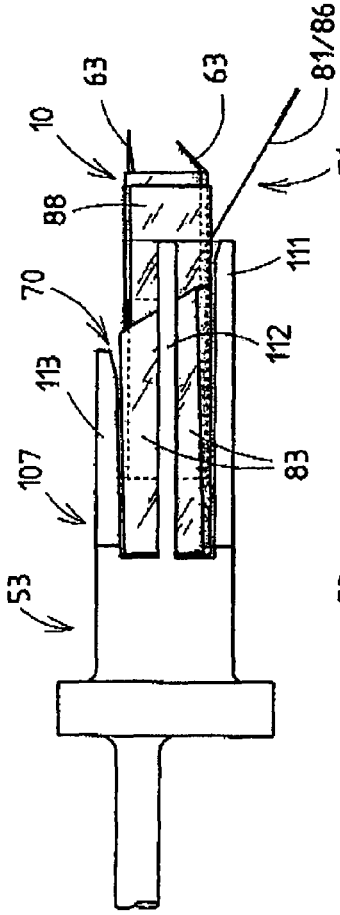
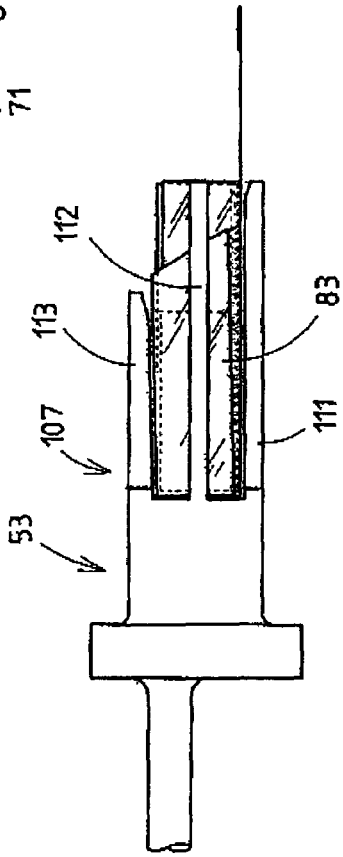
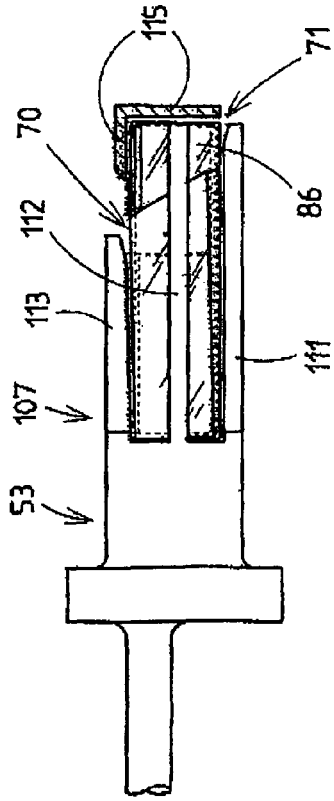

METHOD AND DEVICE FOR PRODUCING HARD PACKS FOR CIGARETTES

DESCRIPTION

The invention relates to a method of producing (hard) packs, such as hinge-lid boxes (hinge-lid packs) or shell and slide packs, with an outer wrapper which is made of (thin) cardboard and encloses pack contents, in particular a cigarette group with an inner wrapper-cigarette block. The invention also relates to an apparatus for implementing the method.

Hinge-lid boxes are commonly used throughout the world as the main type of packaging for cigarettes. This type of pack, with a box part, lid and collar, is of comparatively complex construction. The same applies to cigarette packs of the shell and slide type. Both consist of thin cardboard.

In order to increase the performance of packaging machines for producing (cigarette) packs of the abovementioned type, it is necessary for the production process to be carried out largely continuously. Approaches to the solution relating to the continuous production of hinge-lid boxes or shell and slide packs which have been used up until now are inadequate.

The object of the invention is thus to propose measures for cost-effective, in particular continuous production of hard packs in general and of hinge-lid boxes or shell and slide packs in particular.

In order to achieve this object, the method according to the invention has the following features:

a) the outer wrapper is prefabricated with a cross-sectionally closed, rectangular shell which is open at at least one end as the outer pack unit, b) the pack contents are prefabricated separately using a thin-walled hollow body—folding mandrel—the inner wrapper being positioned and folded on the outside of the folding mandrel, as is at least one additional pack part, in particular a collar or slide, c) the cigarette group is pushed out of the folding mandrel, with the inner wrapper, which is folded and closed in the region of a base wall, and the additional pack part, which rests on the outside, being carried along in the process, to form an inner pack unit, d) immediately following the folding mandrel, the inner pack unit is pushed into the open side of the outer wrapper, which is held ready as a shell adjacent to the folding mandrel, e) folding of the pack is then completed, folding tabs of an end wall of the inner wrapper being folded first of all and then folding tabs of the slide or of a lid being folded.

Accordingly, the idea of the invention is for two pack units, namely the outer wrapper, on the one hand, and the pack contents—cigarette block—with an additional pack part (collar or slide), on the other hand, to be prepared or prefolded separately as they are transported (continuously) along parallel, synchronously controlled movement paths, and then for these pack units to be combined with one another by a movement running transversely to the conveying direction. Thereafter, according to the invention, concluding folding steps are carried out in order to complete the pack.

The inner pack unit is produced on a folding turret which is equipped with hollow folding bodies, namely folding mandrels. The inner wrapper is prepared, and the collar or slide is positioned, on the outside. The cigarette group is located on the inside. The other, outer pack unit is prepared in pockets, or corresponding holders, which circulate synchronously with, and in the same direction as, the folding mandrels.

One special feature is that, in a first movement cycle, only a sub-region of the inner pack unit—cigarette block with collar or slide—is pushed into the box part or into the shell and thereafter—namely following release from the folding mandrel—folding of the inner blank, of the slide and—in the case of hinge-lid boxes—folding of the outer wrapper is completed, before the pack contents are pushed all the way into the box part or into the shell.

A further special feature is constituted by the operations of feeding the collar or the slide to the folding mandrel and of folding this pack part.

Figure 1:
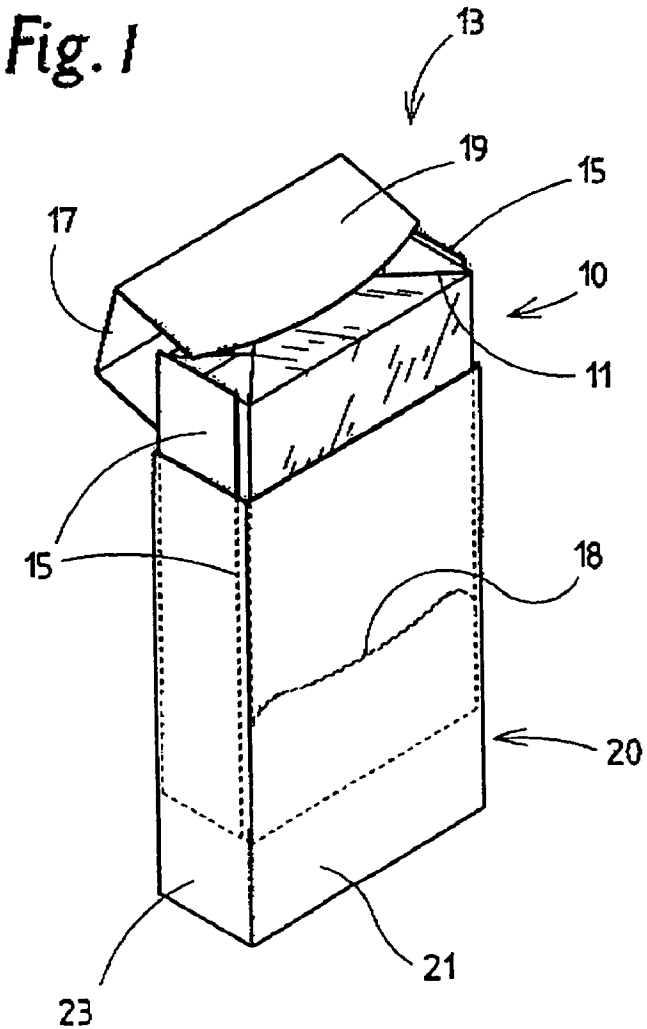
Figure 3:
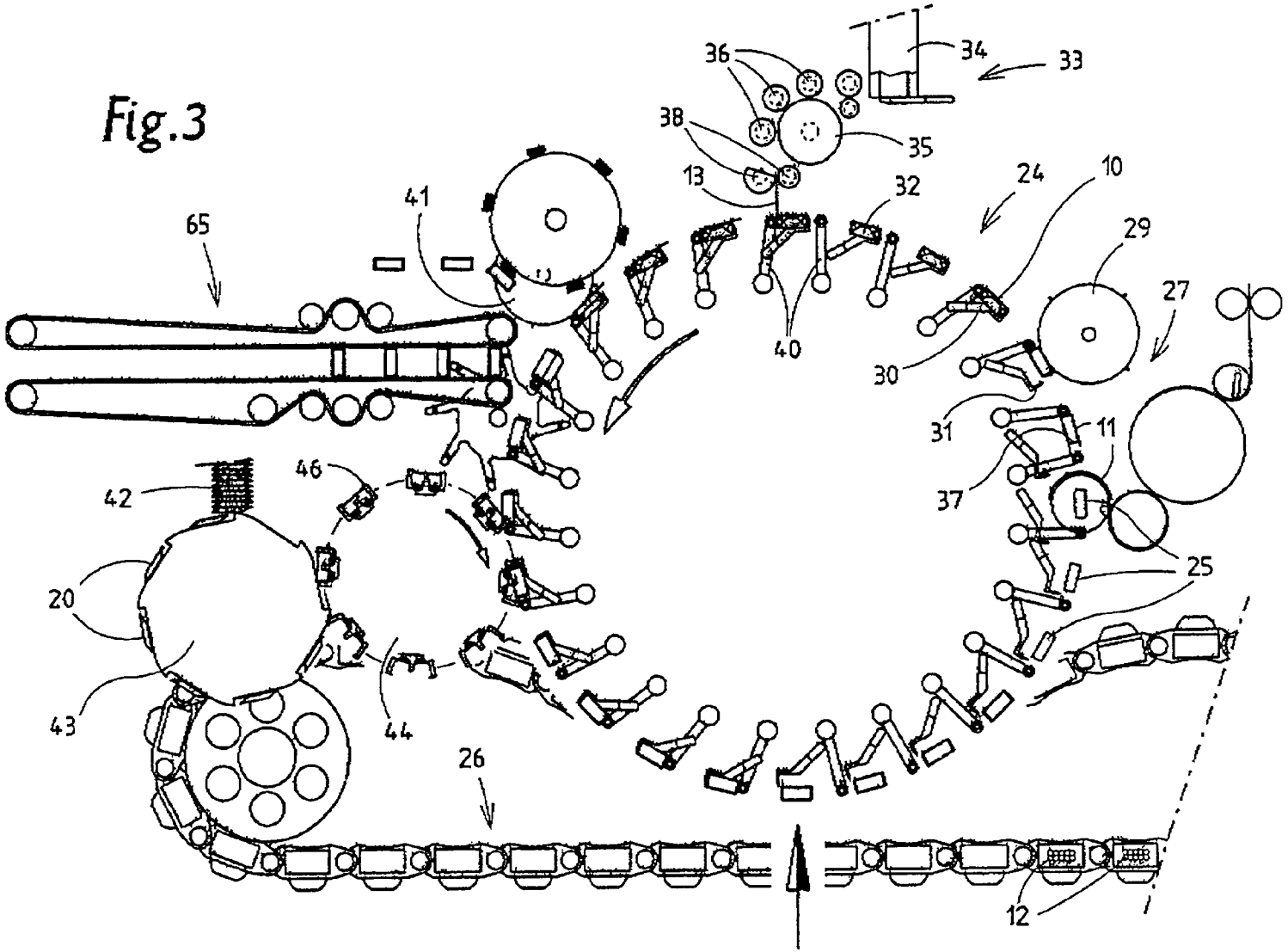
Figure 4:
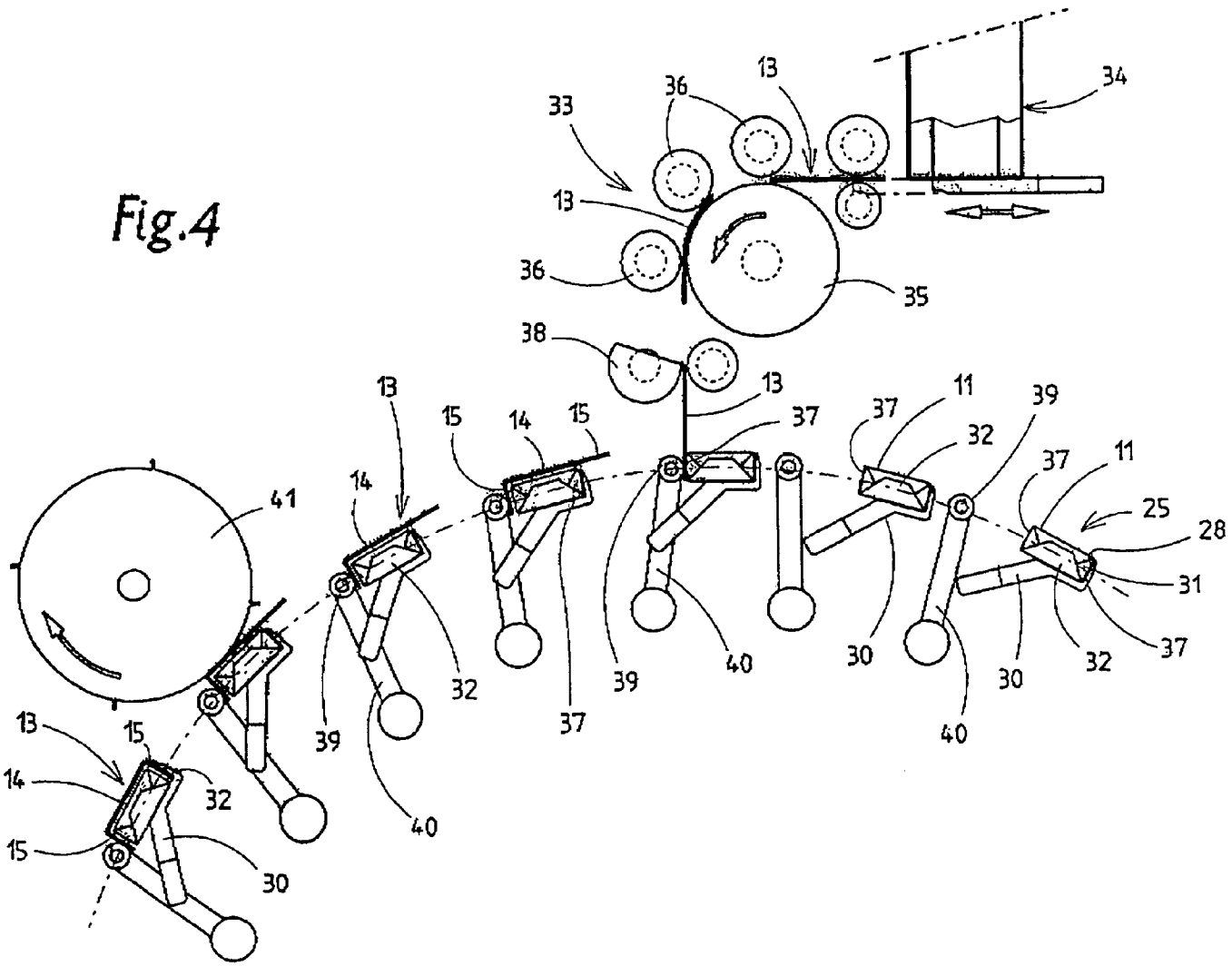
Figure 5:
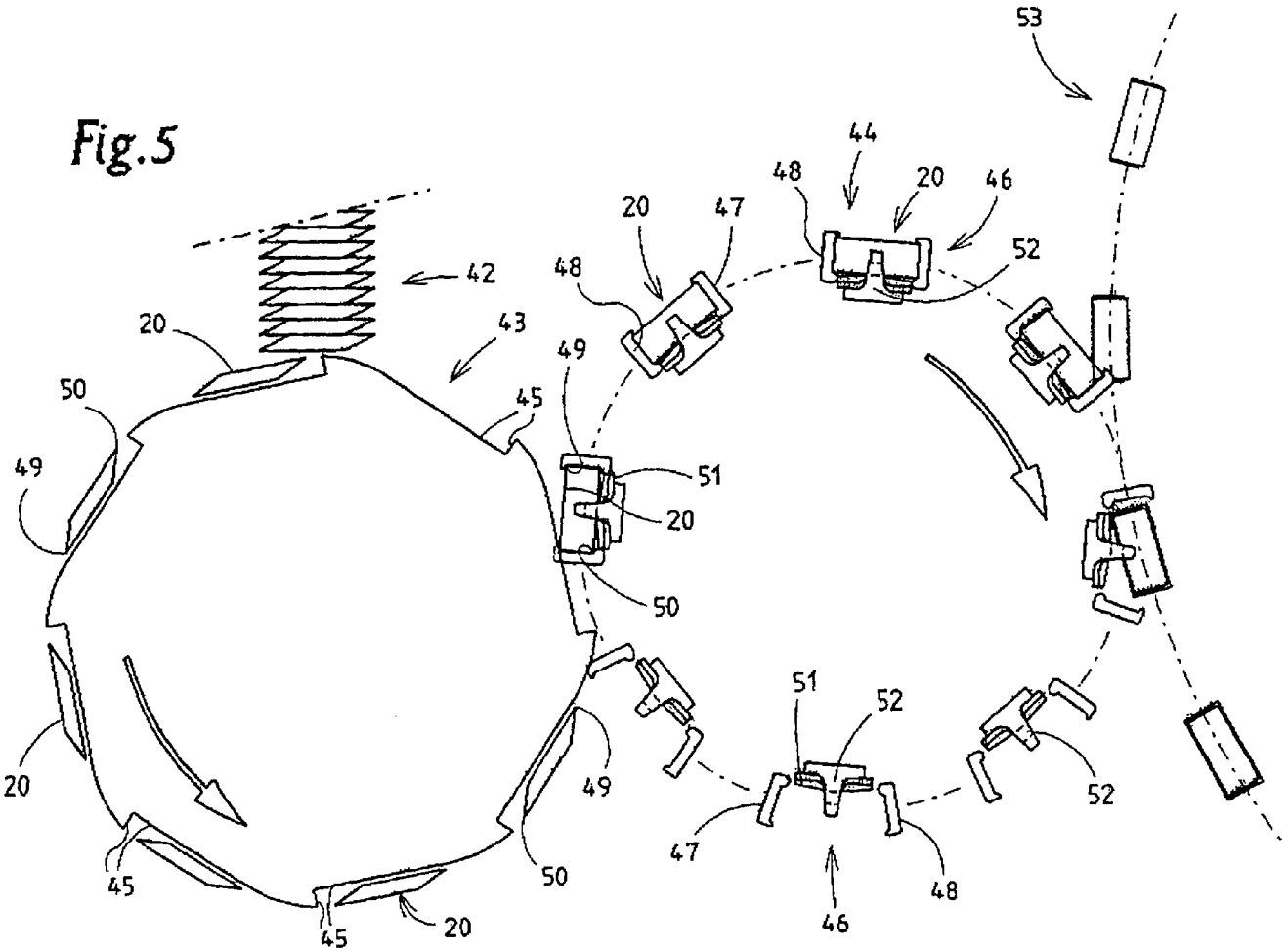
Figure 6:
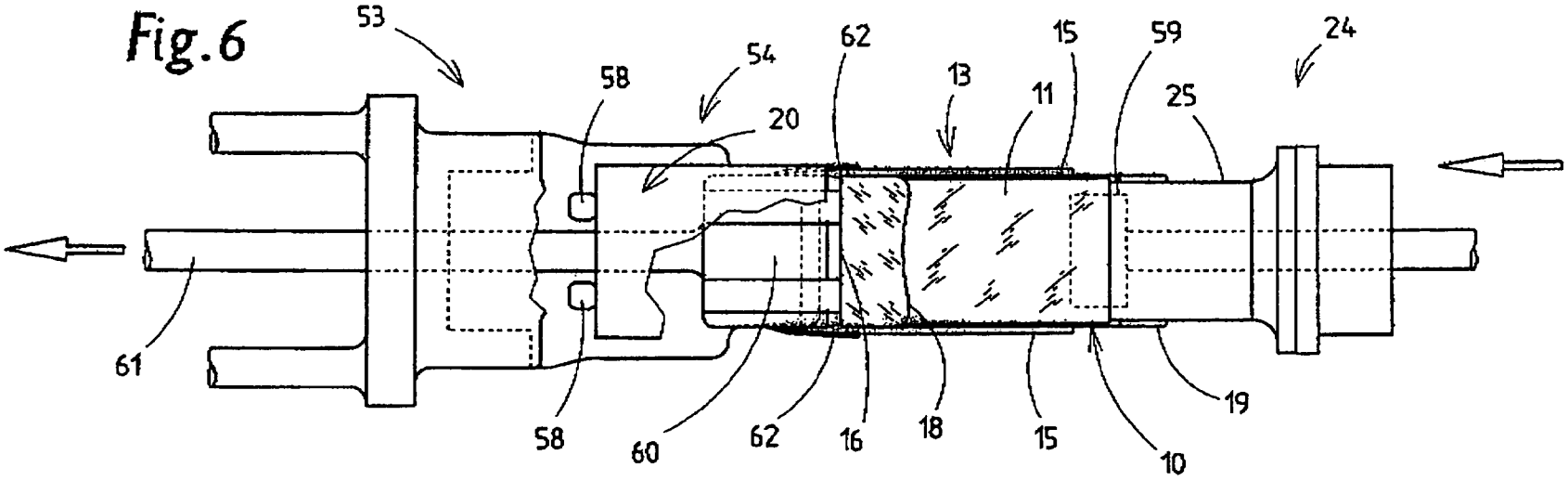
Figure 7:
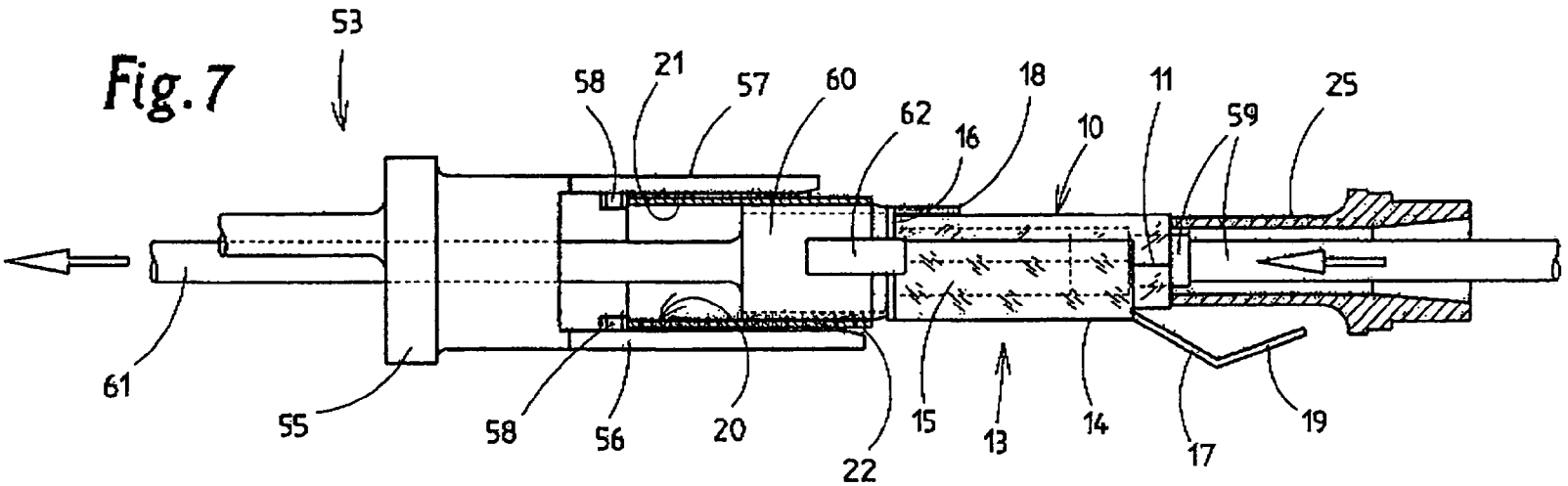
Figure 12:
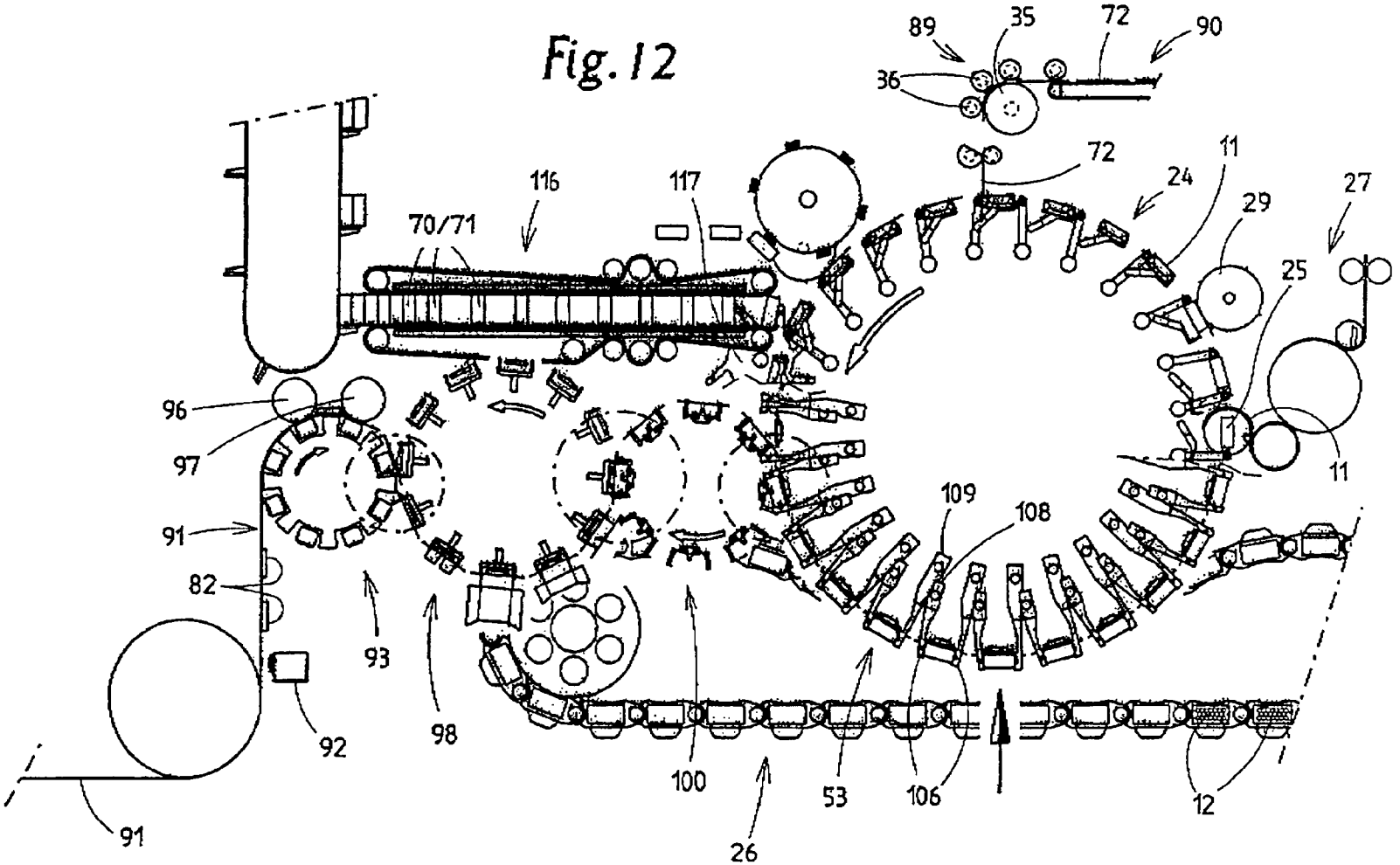
Figure 13:
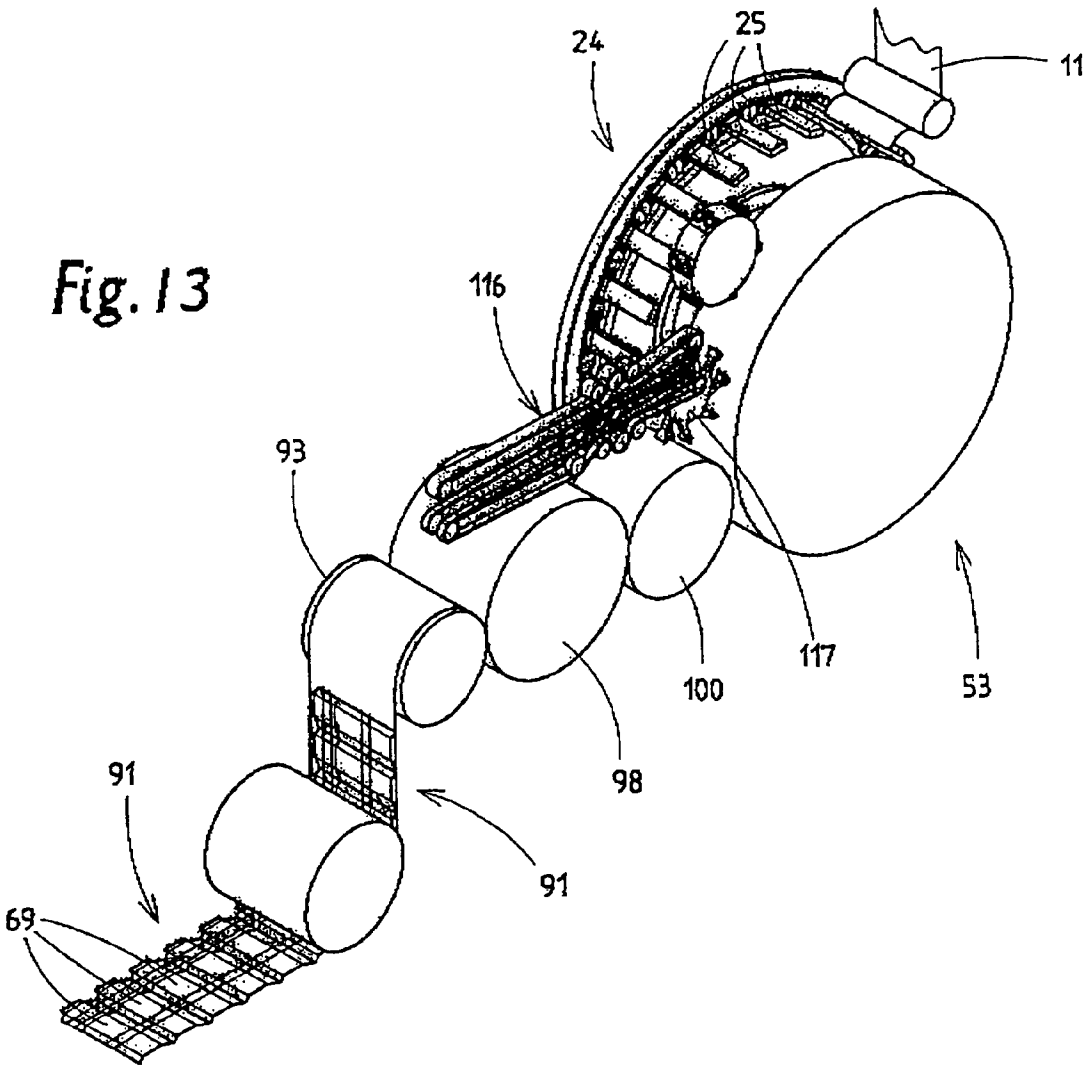
Figure 14:
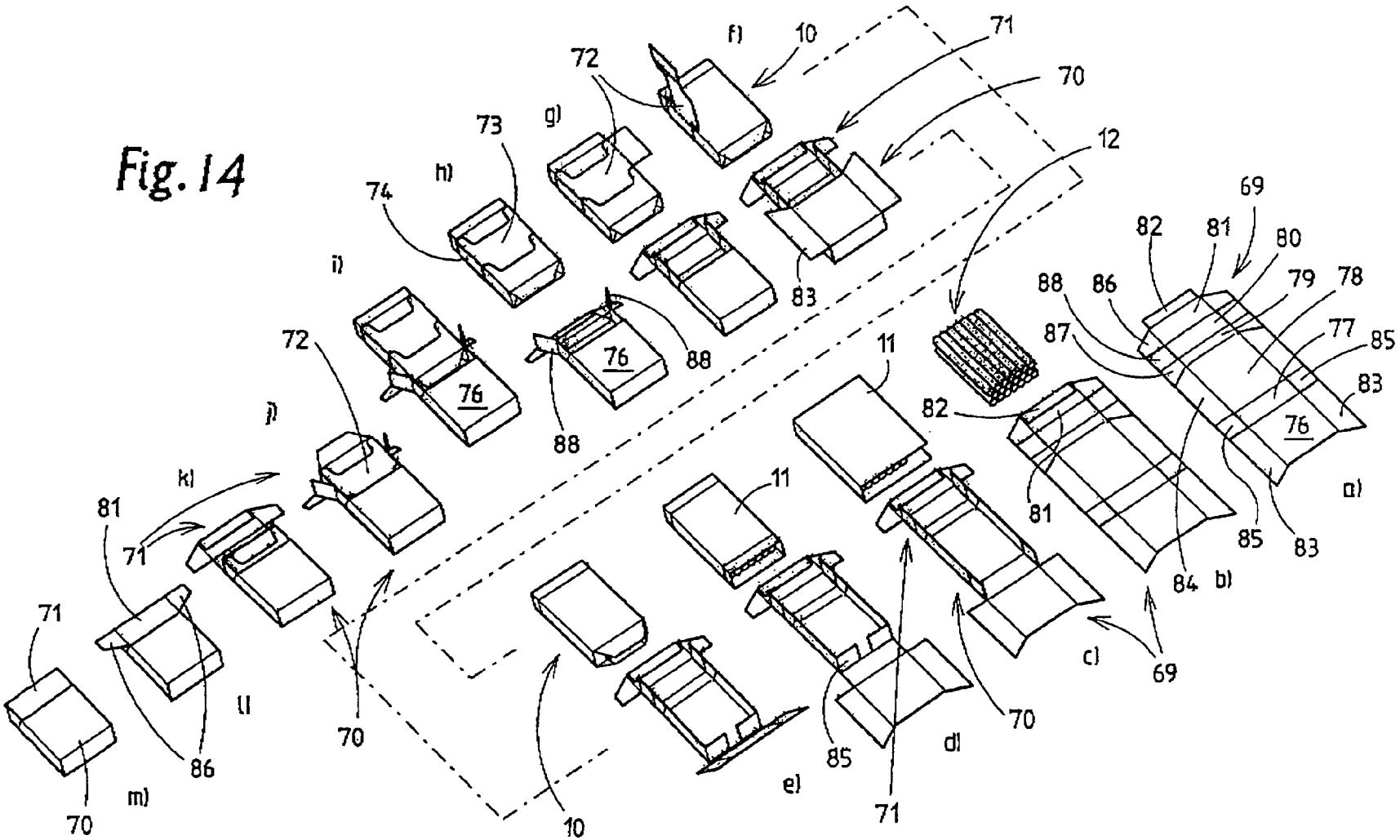
Figure 15:
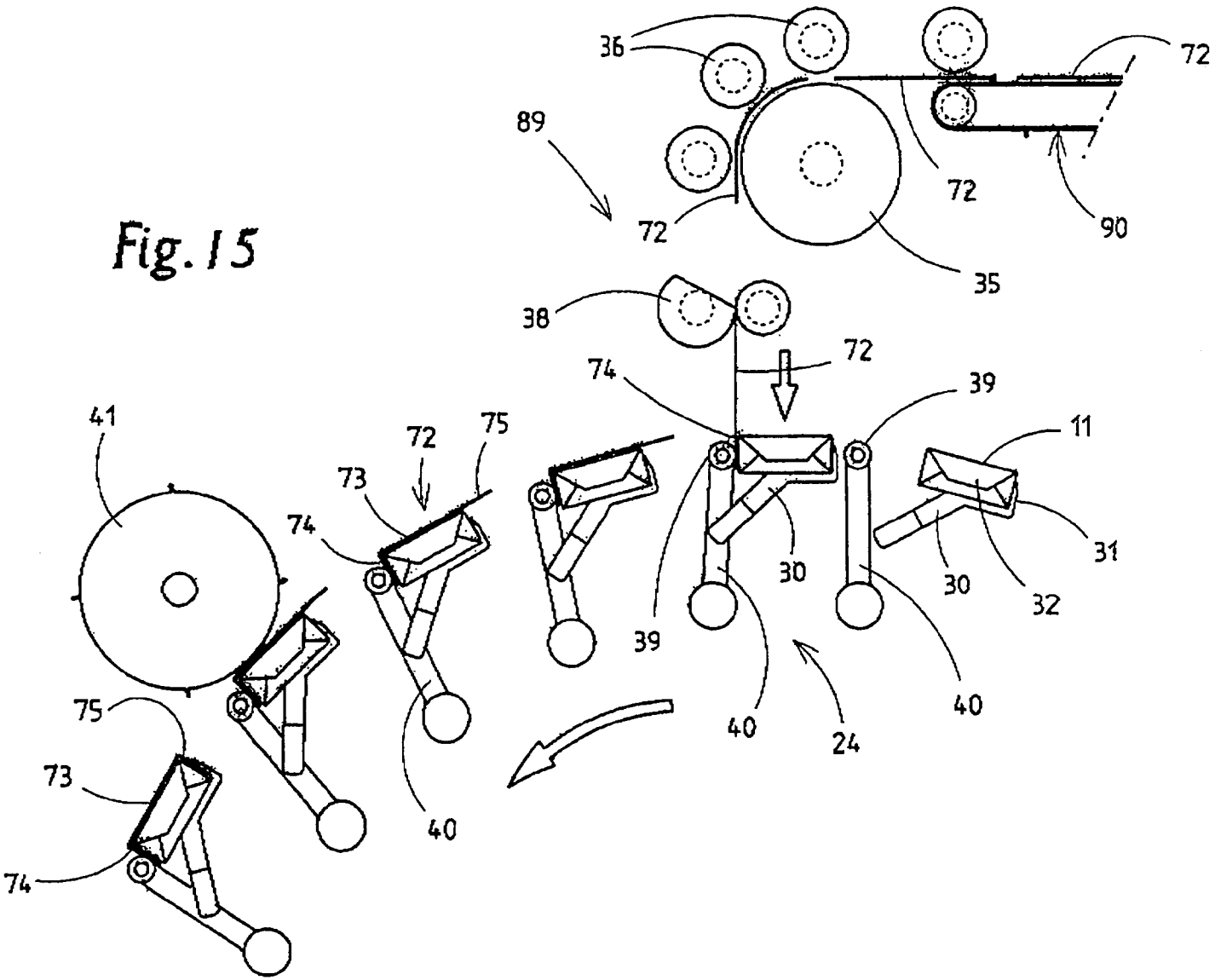
Figure 16:
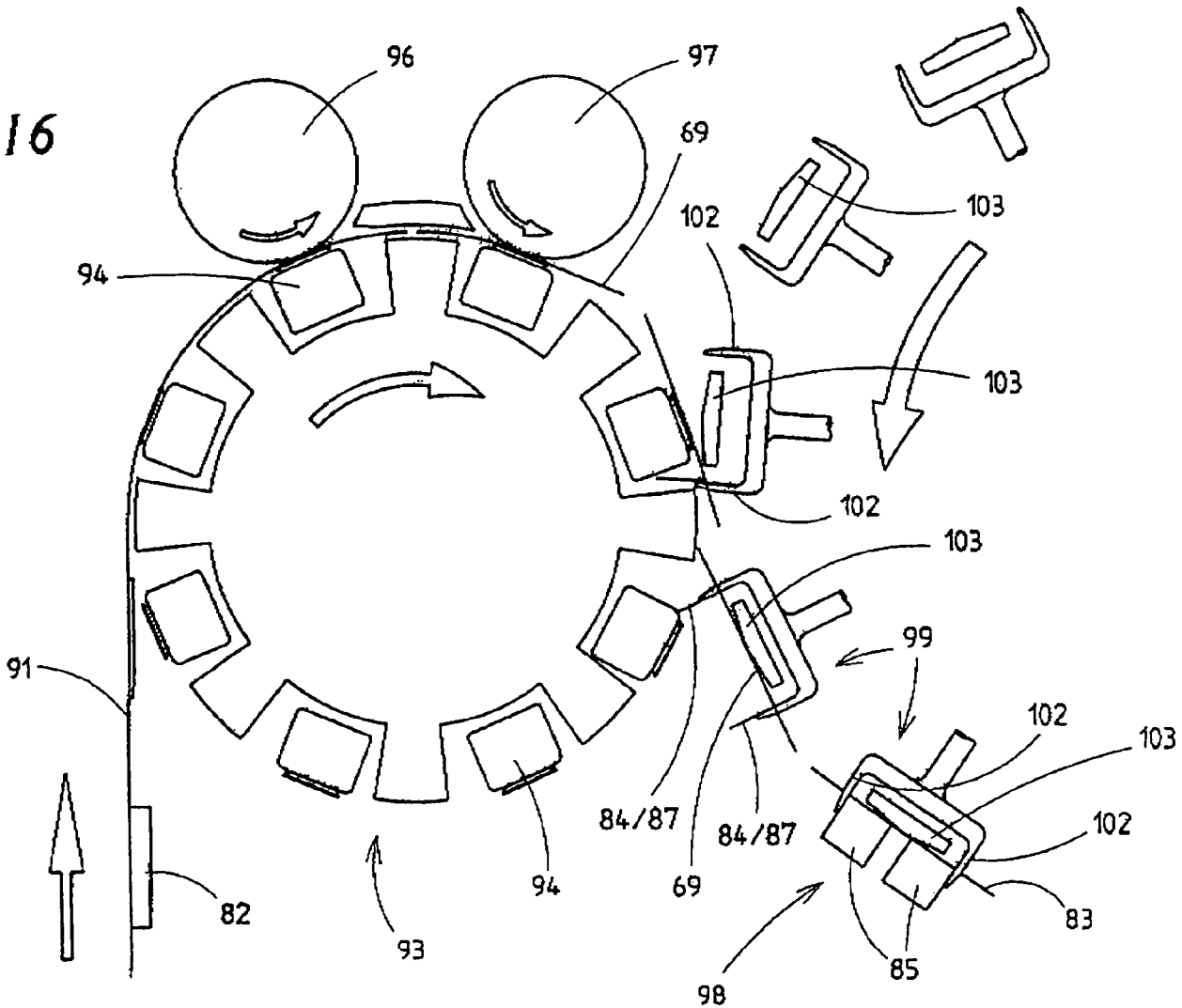
Figure 18:
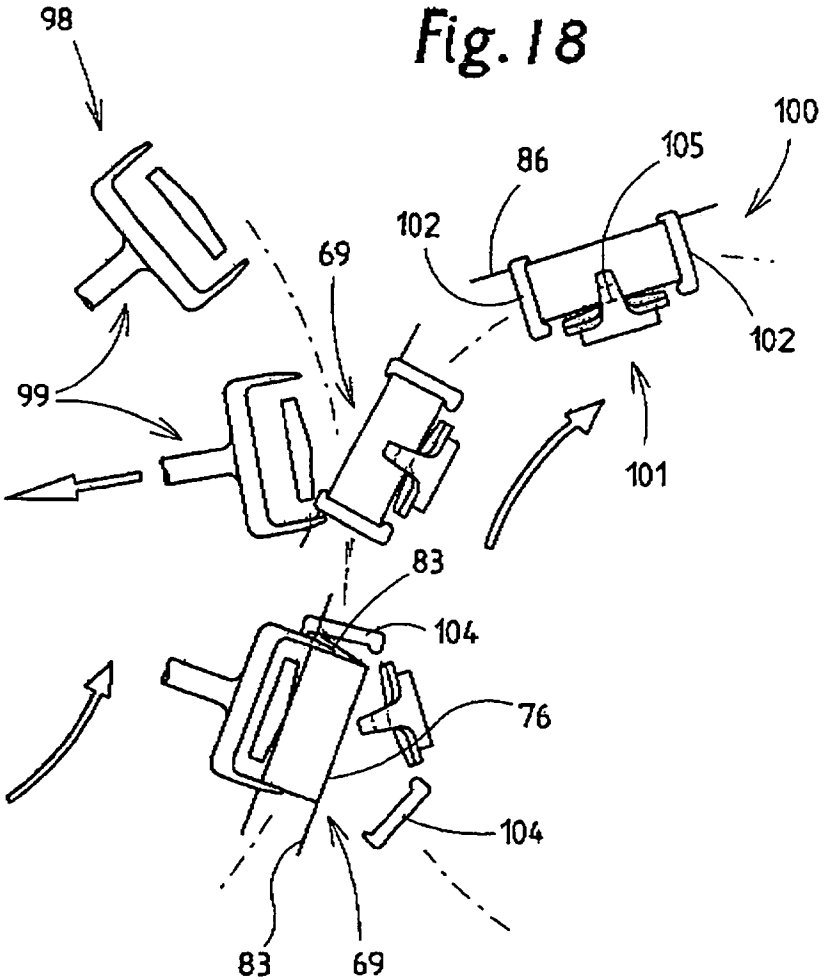
Figure 17:
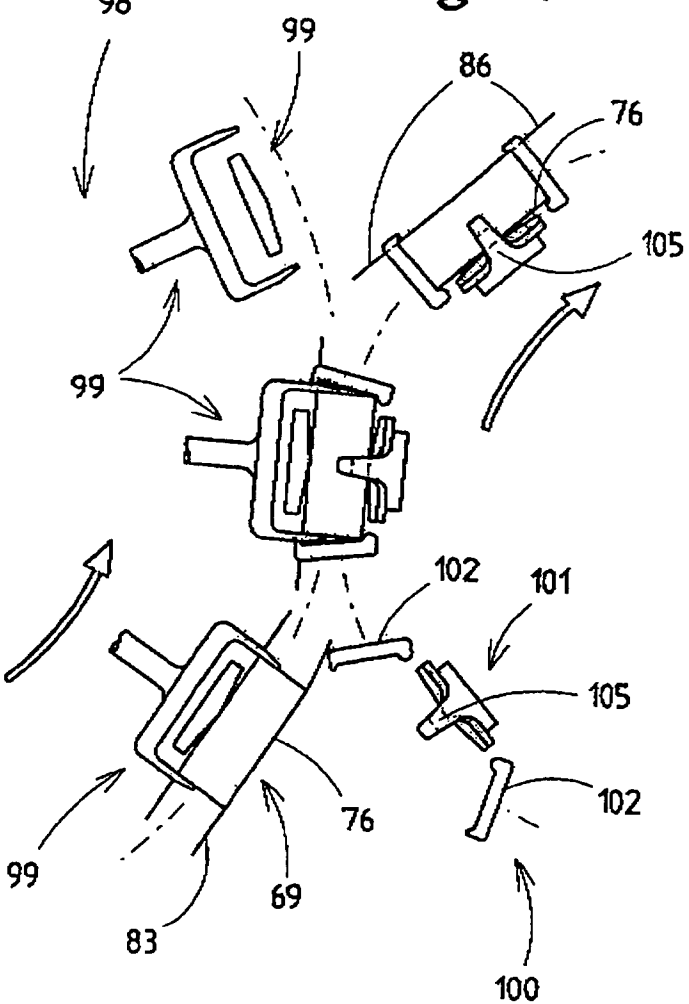
Figure 19:
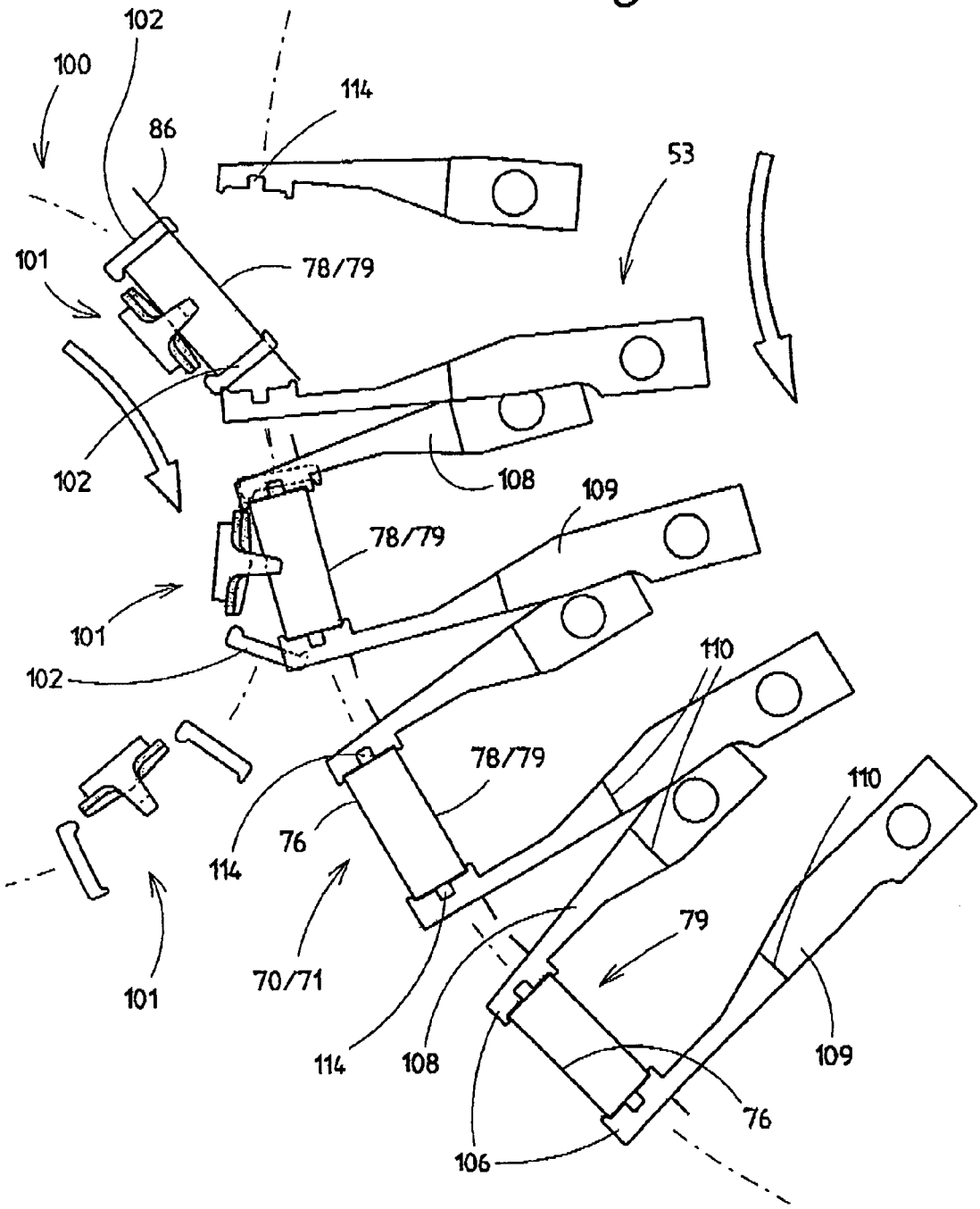
Figures 20, 21:
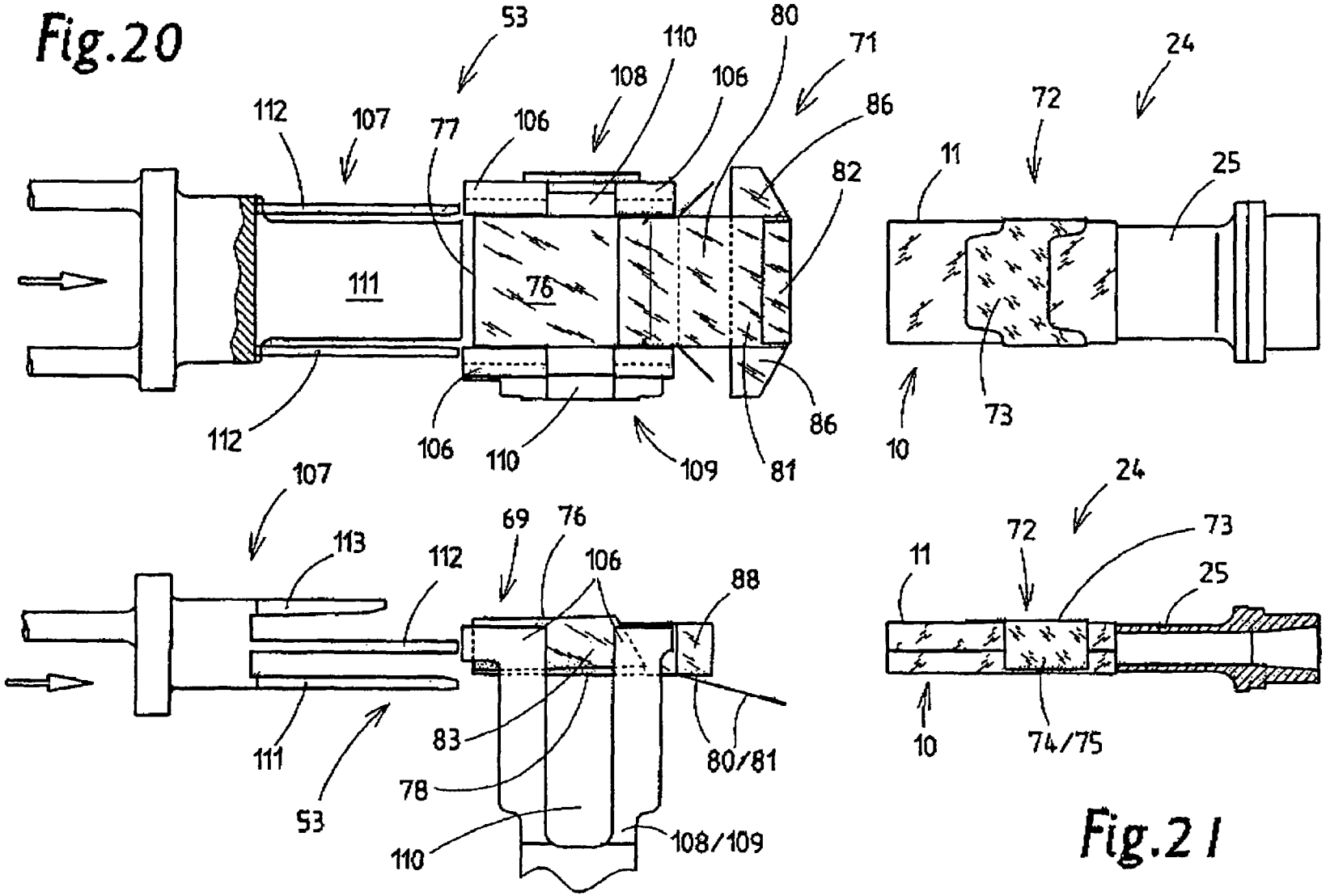
Figure 22:
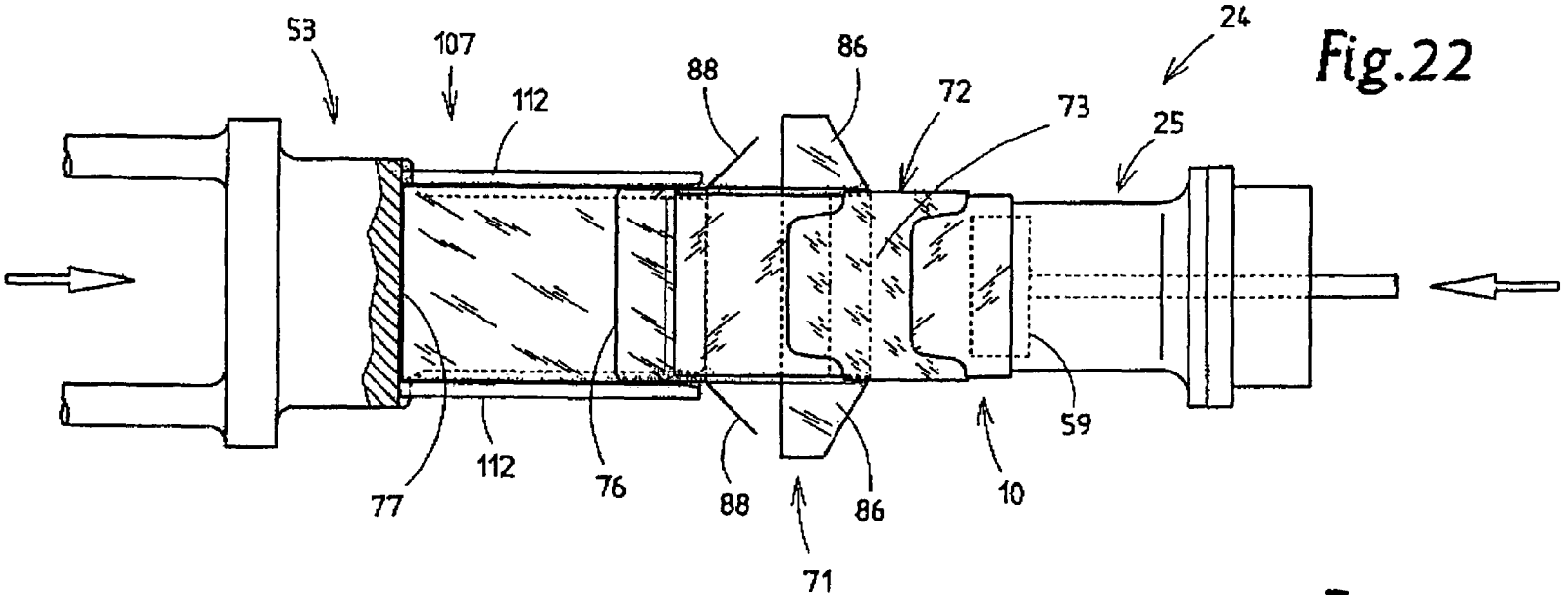
Figure 23:
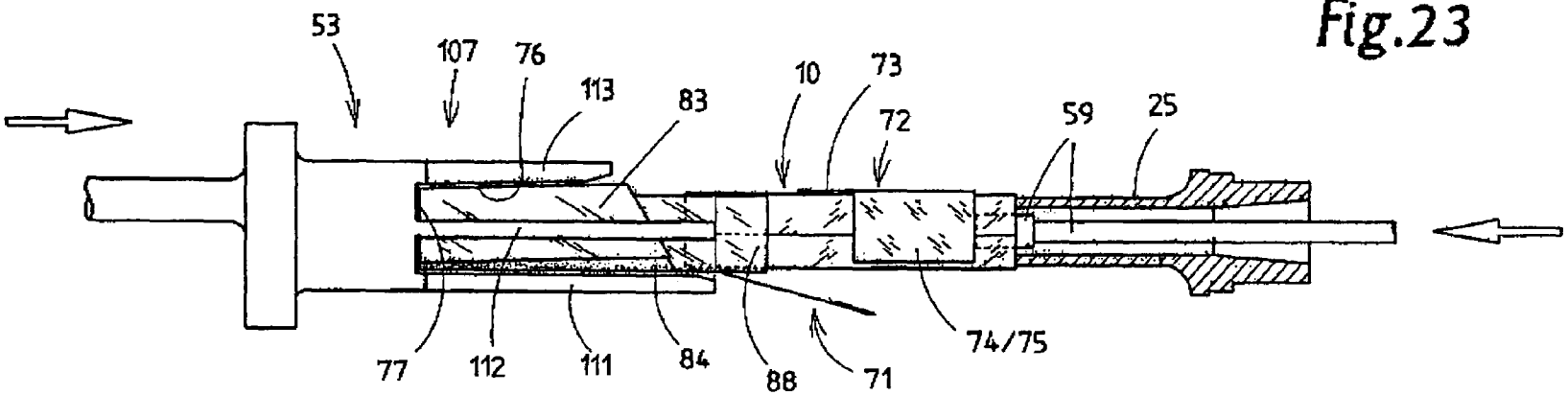

Further details of the method according to the invention and of the apparatuses for implementing the same are explained hereinbelow with reference to the drawings, in which:

FIG. 1 shows a perspective illustration of a (cigarette) pack of the shell and slide type, with the slide open, FIG. 2 shows a perspective illustration of a (cigarette) pack of the hinge-lid-box type, with the lid open, FIG. 3 shows a schematic side view of an apparatus for producing packs of the shell and slide type, FIG. 4 shows, on an enlarged scale, a detail of the apparatus according to FIG. 3, namely the operations of the slide being fed and folded, FIG. 5 shows a phase during which a shell is erected and fed to the folding turret, FIG. 6 shows a plan view of holders of two parallel folding turrets as two pack parts are being brought together, FIG. 7 shows the details according to FIG. 6 in a side view and/or a radial section, FIGS. 8 to 11 show different movement positions of the detail according to FIGS. 6 and 7 in a side view corresponding to FIG. 7, FIG. 12 shows an apparatus analogous to FIG. 3 for producing hinge-lid boxes, FIG. 13 shows a schematic illustration, in perspective, of the most important elements of the apparatus according to FIG. 12, FIGS. 14*a*) to 14*m*) show a perspective illustration of successive folding and production steps during the production of hinge-lid boxes, FIG. 15 shows a detail or part of a folding turret for producing an inner pack unit for a hinge-lid box, FIG. 16 shows, in side view, a schematic illustration of two successive turrets for preparing a blank of a hinge-lid box, FIGS. 17 and 18 show a schematic side view of sub-regions of two successive turrets during the transfer of partially folded blanks of hinge-lid boxes, FIG. 19 shows a schematic side view of details of two turrets, including a sub-region of a main turret, during the transfer of partially folded blanks of a hinge-lid box, FIG. 20 shows a plan view or radial view of a detail of the main turret, namely a pocket with a folding mandrel located opposite, FIG. 21 shows a side view of the detail according to FIG. 20, FIG. 22 shows an illustration analogous to FIG. 20 with elements positioned differently relative to one another, FIG. 23 shows a side view of the detail according to FIG. 22, and FIGS. 24 to 26 show illustrations analogous to FIGS. 21 and 23 for different positions or folding steps.

The exemplary embodiments illustrated in the drawings relate to the production of hard packs for cigarettes. At least one outer wrapper consists of thin cardboard.

FIG. 1 shows a cigarette pack of the shell and slide type. In the case of this type of pack, a cigarette block 10, comprising a cigarette group 12 wrapped in an inner blank 11, is arranged in an inner part of the pack, namely in a slide 13. The latter is of cross-sectionally U-shaped design, comprising a slide wall 14, side crosspieces 15, a base flap 16 and an end flap 17. The base flap 16 and end flap 17 each have a continuation, namely a respective insertion flap 18, 19. The slide 13 likewise consists of cardboard.

An (inner) pack unit, which is formed from the cigarette block 10 and slide 13, is arranged in an outer wrapper, namely in a shell 20. This is a cross-sectionally closed outer pack unit which is open at both ends and has a front wall 21, rear wall 22 and side walls 23. During continuous production, the two pack units are conveyed, folded and completed in two parallel movement paths, and then combined, by means of transverse displacement, to form the pack.

A first folding turret, namely a mandrel turret 24, has the task of preparing the pack unit comprising the cigarette block 10 and slide 13. The mandrel turret 24 has a multiplicity of circumferentially distributed folding mandrels 25, that is to say thin-walled hollow bodies which are open at both ends. In each case one cigarette group 12 is accommodated in the interior of the cross-sectionally rectangular folding mandrel 25. The cigarette groups 12 are fed to the mandrel turret 24 by an endless conveyor, namely by a pocket chain 26. In the region of a circumferential section, the pocket chain 26 runs in axial alignment with the folding mandrels 25. The cigarette groups 12 are pushed in the axis-parallel direction out of the pockets of the pocket chain 26, and into an associated folding mandrel 25, in this region (U.S. Pat. No. 4,750,607).

With continued rotary movement of the mandrel turret 24, the folding mandrels 25, each with a cigarette group 12, pass into the region of a blank station 27. In the region of the latter, an inner blank 11 is held ready and positioned on the folding mandrel 25. The inner blank 11 here is positioned such that on a rear side wall 28 of the folding mandrel 25, as seen in the direction of rotation, folding tabs project, of which an inner folding tab which is located in the radially outer direction is folded against the side wall 28 by a folding element 29, and then an outer folding tab is folded against the side wall 28 by a folding lever 30. The folding lever 30 is of angled design with an approximately radially directed folding leg 31. The latter fixes the two folding tabs of the inner blank 11 on the side wall 28 of the folding mandrel 25.

With continued rotation of the folding turret or mandrel turret 24, a base folding formation 32 of the inner blank 11, this being formed by projecting folding tabs at the free end of the folding mandrel 25, is produced, to be precise by known, conventional folding elements.

A following slide station 33, as seen in the movement direction of the mandrel turret 24, is designed in a particular manner. In the region of this station, a blank for forming the slide 13 is fed and positioned on the outside of the folding mandrel 25, or of the inner blank 11, in order to form the pack unit comprising the cigarette block 10 and slide 13. The blanks for the slide 13 are removed from a blank magazine 34 and deflected in a non-folded state from a horizontal plane into a vertical plane, to be precise by a deflecting roller 35. The blanks are then moved downwards in the vertical plane. The slide station 33 is positioned above the mandrel turret 24, which rotates in a vertical plane. The blanks of the slide 13 are fed radially to an associated folding mandrel 25 as the rotary movement continues (FIG. 4). In order to deflect the blank, the deflection roller 35 is assigned a plurality of counter-rollers 36 arranged on the outer circumference.

The slide 13 is then transferred to the mandrel turret 24 such that a border region butts against a front side wall 37 of the folding mandrel 25, or of the inner blank 11, as seen the direction of rotation. The blank of the slide 13 is fed transversely to the longitudinal extent. A front side crosspiece 15, as seen in the conveying direction, butts against the side wall 37. By virtue of a corresponding design of a conveyor roller 38, the blank of the slide 13 is then freed and can be carried along by the mandrel turret 25. The slide 13 here is fixed on the relevant folding mandrel 25, mainly on the front side wall 37, to be precise by a pressure-exerting element, namely a pressure-exerting roller 39, which is positioned on a lever 40 and, on account of correspondingly controlled movement, retains the blank of the slide 13 on the folding mandrel 25 or inner blank 11.

As the mandrel turret 24 moves further, the slide 13 is folded around the folding mandrel 25 by known folding elements. A leg which projects on the rear side, as seen in the conveying direction, is folded around against the rear side wall 28 by a folding wheel 41 (on the left in FIG. 4). The folding lever 30 is actuated for a short time here such that the folding leg 31 can be lifted up and the side crosspiece 15 can be folded. This is then also fixed by the folding lever 30.

As the mandrel turret 24 rotates further, the base flap 16 of the slide 13, including the associated insertion flap 18 is folded. The inner pack unit, formed on the folding mandrel 25, is thus completed.

The other pack unit is prepared separately, albeit in a coordinated and synchronized manner. This other pack unit is the shell 20, which is prepared in a parallel, upright plane which is offset in relation to the mandrel turret 24. For this purpose, ready prepared, collapsed shells 20 are removed from a shell magazine 42 and fed to an intermediate turret 44 by a shell turret 43. The shell turret 43 has a plurality of circumferentially arranged planar abutment surfaces 45 with an approximately radially directed transverse surface. The shells 20 are retained on the abutment surfaces 45 in each case by way of a large-surface-area wall, to be precise by suction bores (not shown).

The intermediate turret 44 has pockets 46 as mounts for the shells 20. As they are transferred to the intermediate turret 44, the shells 20 are erected into three-dimensional form. The sequence can be gathered from FIG. 5. The pockets 46 have moveable, namely pivotable lateral pocket walls 47, 48. When the empty pockets 46 are fed for receiving a shell 20, the pocket walls 47, 48 are located in an open, spread-apart position (at the bottom in FIG. 5). The movement of the shell turret 43 and the intermediate turret 44 relative to one another is controlled and/or selected such that the shell 20 has a front folding edge 49, as seen in the transporting direction, conveyed against the front pocket wall 47 of a pocket 46, as seen in the direction of rotation. A folding edge 50, which is located diagonally opposite on the rear side of the shell 20, is gripped by the other following pocket wall 48. The shell 20 is erected by virtue of the pocket walls 47, 48 being moved together.

The pockets 46 have a slightly curved base 51, against which the shell 20 butts by way of the front wall 21 or rear wall 22. Also provided is an end holder 52, which aligns the shell 20 axially in the pocket 46.

The intermediate turret 44 transports the shells 20 to a further turret, namely a pocket turret 53. The latter forms the counterpart to the mandrel turret 24, is mounted equiaxially with the latter and is driven continuously in rotation and synchronously with the mandrel turret 24. In particular, the mandrel turret 24 and pocket turret 53 are designed as a turret unit with two sub-turrets, in a manner analogous to U.S. Pat. No. 5,979,140.

The pocket turret 53 is provided along the circumference with mounts for the shell 20, namely with shell pockets 54. The two holders, namely folding mandrels 25 on the one hand and shell pockets 54 on the other hand, are conveyed along endless, namely circular movement paths, a folding mandrel 25 having an associated shell pocket 54 spaced apart opposite it in a precisely aligned manner in each case. As the two turrets 24 and 53 rotate, if appropriate, folding and displacement movements are carried out. The shells are transferred from the intermediate turret 24 such that the shell pockets 54 are located in a position in which they are retracted in the axis-parallel direction. The shells 20, then, are retained in a receiving position in a region between the shell pockets 54, on the one hand, and the folding mandrels 25, on the other hand. The shell 20 which is held ready is received by way of axis-parallel displacement of the shell pocket 54.

Figure 8:
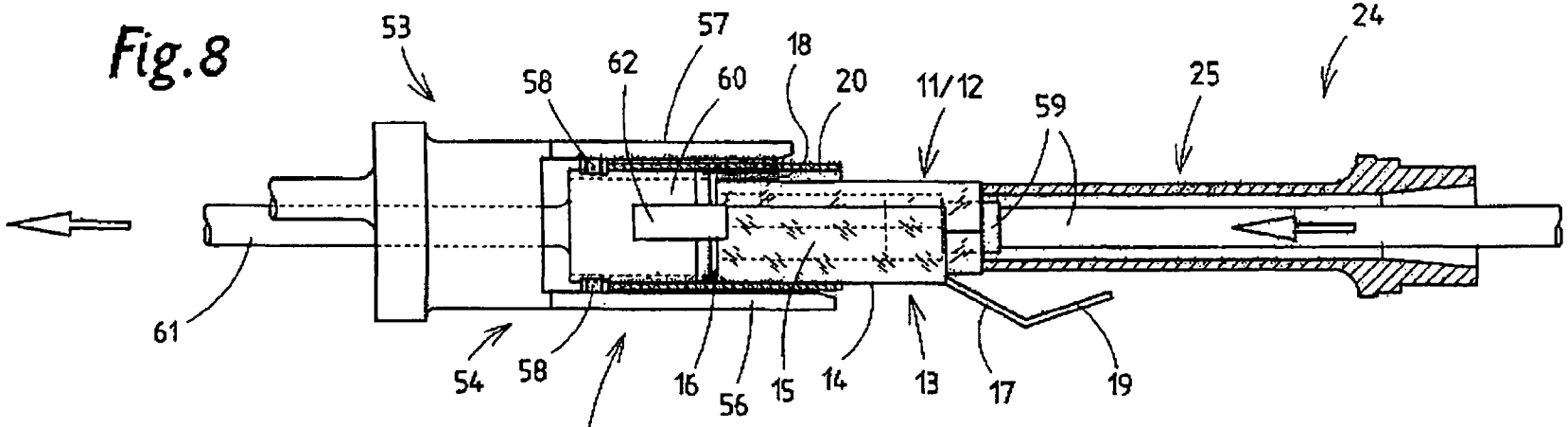

When the slide 13 has been folded, in the region of the folding mandrels 25, in accordance with FIG. 8, that is to say with the insertion flap 18 butting against the cigarette block 10 but with the end flap 17 straightened out, and not yet folded, the two pack units are fed to one another. This takes place in such a way that the holder of the shell 20, namely the shell pocket 54, is displaced in the axis-parallel direction, that is to say tranversely to the conveying direction, towards the folding mandrel 25 into a position according to FIGS. 6 to 9. In this position, the shell pocket 54 is spaced apart by a relatively small distance from the facing, free end of the folding mandrel 25. The shell pockets 54 are open on the side which is directed towards the folding mandrel 25, with the result that the shell 20 has a free opening facing the folding mandrel 25. On the opposite side, the shell pocket 54 is positioned on a carrying component 55 which, for its part, is connected to the pocket turret 53. The shell pocket 54, furthermore, comprises a radially inner carrying wall 56 and a shorter outer wall 57 located opposite. The front wall 21 and rear wall 22 of the shell 20 butt against the carrying wall 56 and the outer wall 57. The precise position of the shell 20 within the shell pocket 54 is ensured by top and bottom stops 58, which are arranged in pairs on the inside of the carrying wall 56, on the one hand, and outer wall 57, on the other hand. The shell 20 has a free edge butting against these stops.

In the position in which the shell pocket 54 with shell 20 is adjacent to the folding mandrel 25, the other pack unit is pushed into the shell 20. A pusher 59 acts within the folding mandrel 25 for this purpose, the pusher gripping the cigarette group 12 and pushing it out of the folding mandrel 25 at the free end. In this case, the inner blank 11, which is folded on the outside of the folding mandrel 25, and the partially folded slide 13 are also drawn off from the folding mandrel 25. This pack unit is pushed into the open shell 20 (FIGS. 8 and 9) in the process.

Located within the shell 20 is a steadying element 60, which is connected to the shell pocket 54 and can be displaced via a push rod 61. This steadying element 60, which largely fills the cross section of the shell 20, is first of all moved up to the free end of the shell 20. The unit which is fed by virtue of being pushed off from the folding mandrel 25 first of all comes into abutment against this steadying element 60 by way of the base flap 16 of the slide 13 (FIGS. 6 and 7). This region of the slide 13 is, namely the base flap 16 and insertion flap 18 are, thus fixed in the form which is appropriate for the pack (FIG. 7).

In each case one guide element, namely a narrow, thin-walled guide crosspiece 62, is arranged on both sides of the steadying element 60. These guide crosspieces are designed to diverge slightly in the direction of the folding mandrel 25. They serve for gripping and retaining the two side crosspieces 15 of the slide 13 in the position of abutment against the cigarette block 10.

Figure 9:
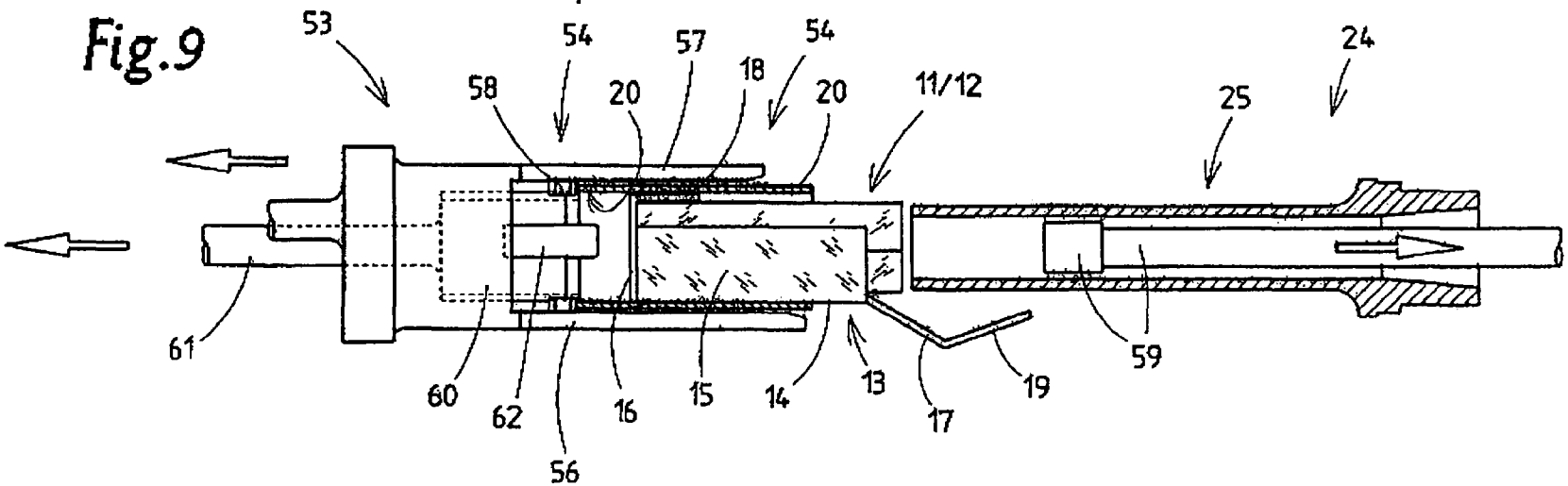
Figure 10:
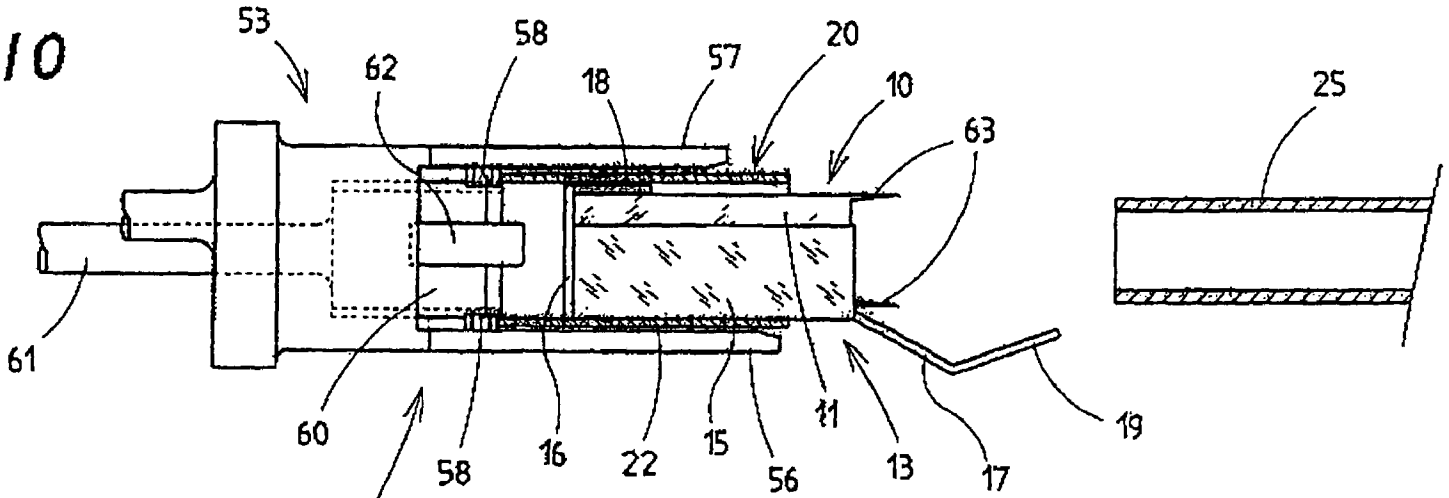
Figure 11:
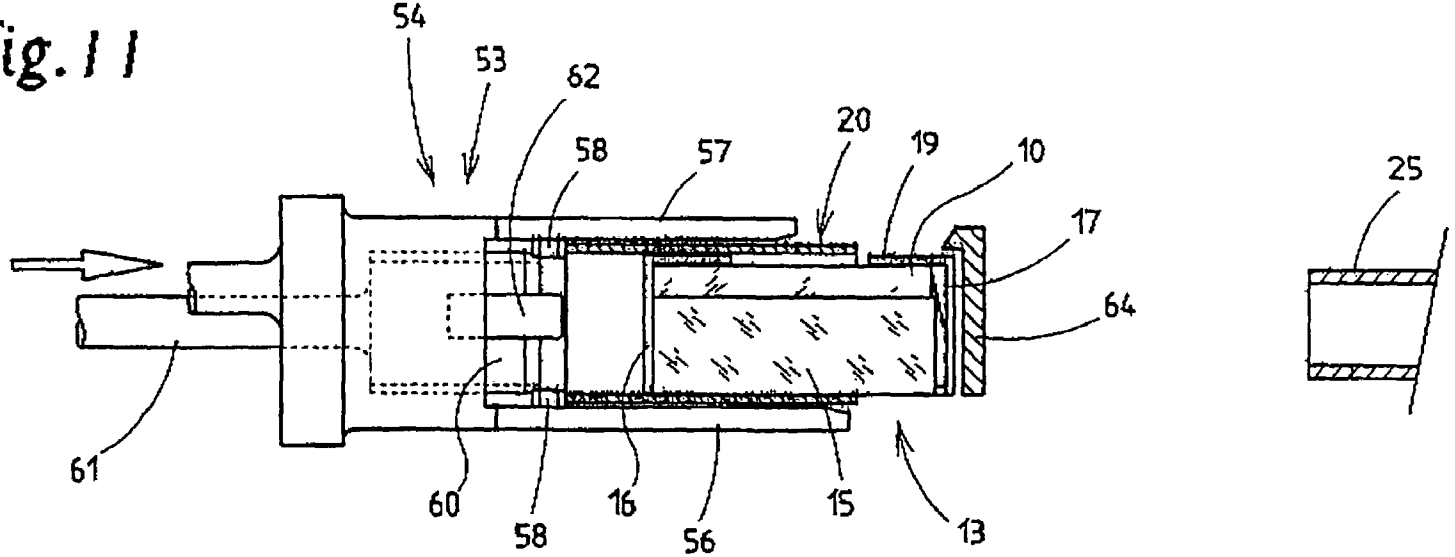

In accordance with the pack unit being fed from the folding mandrel 25 into the shell 20, the steadying element 60 is retracted within the shell, to be precise into a position in which most of the cigarette block 10 and slide 13 is positioned within the shell 20 (FIG. 9). Furthermore, the shell pocket 54 returns into the starting position, namely with a relatively large distance from the folding mandrel 25 (FIG. 10).

In this position, folding of the inner blank 11 first of all and then of the slide 13 is completed. In the position according to FIG. 10, inner end folding tabs have already been folded. Longitudinal folding tabs 63 of the end wall are directed in an axis-parallel manner. Folding elements of known configuration are used to fold the longitudinal folding tabs 63 one after the other, as the pocket turret 53 rotates, in order to form the typical end folding formation of the cigarette block 10, which can be seen in FIG. 1. Thereafter, the end region of the slide 13, namely the end flap 17 and the insertion flap 19 which is positioned thereon, is folded, to be precise by a folding diverter 64 (FIG. 11), which is positioned in a stationary manner in the movement path of the packs or shell pockets 54. The unit comprising the cigarette block and slide 13 is then pushed all the way into the shell 20, to be precise by virtue of the shell pocket 54 with the shell 20 being moved in the direction of the folding turret 25, the cigarette block 10 and slide 13 being supported on the angular folding diverter 64. The finished cigarette packs are then discharged from the pocket turret 53 to a removal conveyor 65.

Cigarette packs of the hinge-lid-box type (FIG. 2) are produced in an analogous manner. The typical hinge-lid box comprises a single-piece blank 69 for forming the box part 70 and lid 71. A collar 72, which in this case comprises a separate blank, is fixed within the box part 70. This collar encloses the top part of the cigarette block 10 by way of the collar front wall 73 and collar tabs 74, 75. The collar 72 is folded in a U-shaped manner, the two collar tabs 74, 75 being located in the region of side walls.

The typical blank 69 for a hinge-lid box can be gathered, in particular from FIG. 14*a*). Accordingly, in a central part of the elongate blank, a front wall 76, base 77, rear wall 78, lid rear wall 79, end wall 80, lid front wall 81 and lid inner tab 82 are formed as successive zones which are marked by folding lines. Outer side tabs 83, inner side tabs 84, base corner tabs 85, (outer) lid side tabs 86, (inner) lid side tabs 87 and lid corner tabs 88 extend on both sides of the blank 69.

The hinge-lid box designed in this way is produced such that the abovedescribed blank forms one pack unit and the cigarette group 12 with inner blank 11, that is to say the cigarette block 10 with collar 72, forms the second pack unit. The two pack units are produced or prepared separately from one another, albeit in synchronously controlled operating steps, and combined with one another. Production or preparation takes place during continuous transportation along circular movement paths.

The sequence of the folding steps of the two pack units is shown schematically in FIG. 14, the simultaneously executed steps being positioned opposite one another. First of all, the lid inner tab 82 of the blank is folded over (FIG. 14*b*)). Lateral folding tabs, namely the inner side tabs 84 and 87 and corner tabs 85 and 88, are then erected. The base corner tabs 85 are subsequently folded into a transversely directed position, namely a position corresponding to the pack (FIG. 14*c*)). According to FIG. 14*d*), part of the blank, namely the base 77 with front wall 76 and side tabs 83, is erected as a leg. This leg is then folded over again until it butts against the erected inner side tabs 84 and base corner tabs 86. The outer side tabs 83 are then folded until they butt against the inner side tabs 84 (FIG. 14*f*)). This produces a shell-like pack part which is open on one side, namely at the top, in other words the box part 70. The unit comprising the cigarette block 10 and collar 72 is then pushed part of the way into this box part (position in FIG. 14*j*)). Once concluding folding steps have been carried out, the inner pack unit is pushed all the way into the largely folded blank of the hinge-lid box. The latter is then completed by further folding steps in the region of the lid 71—FIGS. 14*k*) to 14*m*).

The two pack units are prepared in the region of parallel movement paths. The cigarette block 10 with collar 72 is transported and folded by a folding turret, namely by the mandrel turret 24. The latter is designed in a manner analogous to the mandrel turret 24 of FIGS. 3 and 4. Instead of the slide station 33, a collar station 89 is formed here above the mandrel turret 24, which circulates in a vertical plane. In the region of this collar station, non-folded blanks of the collar 72 are fed on a collar conveyor 90 and, in a manner analogous to the slide 13, are transferred radially to the mandrel turret 24 and positioned on a folding mandrel 25 or an inner blank 11. The front collar tab 74, as seen in the transporting direction of the collar 72, is positioned against the front side wall 37 of the folding mandrel, as seen in the conveying direction of the mandrel turret 24, and is fixed in this position by a moveable retaining element, namely by a pressure-exerting roller 39. Thereafter, the collar 72 is folded over in a U-shaped manner around the inner blank 11 or the folding mandrel 25 by further folding elements, including a folding wheel 41 (FIG. 15). All of the production or folding steps in the region of the mandrel turret 24 are illustrated schematically in sequence in FIGS. 14*b*) to 14*h*).

The outer pack unit is prepared or produced, that is to say the blank of the hinge-lid box is folded, in a number of regions, the blank passing through a plurality of conveyors or turrets in the region of which individual folding steps are carried out. The apparatus is shown schematically in its entirety in FIG. 13, the inner pack unit being produced in a first operating plane, defined by the mandrel turret 24, and the outer pack unit being produced in a second operating plane, which is parallel to the first, offset in relation to it, and is determined by a number of successive turrets and, ultimately, by a pocket turret 53.

The blanks for the hinge-lid box are fed as a continuous material web 91 with blanks directed transversely to the latter (for example in accordance with U.S. Pat. No. 4,898,569). In the region of an upwardly directed conveying section of the material web 91, the lid inner tabs 82 are folded continuously by known, stationary folding elements. A monitoring element 92 monitors the correct folding of the lid inner tabs 82.

In the region of a first turret, namely of a severing turret 93, the individual blanks according to FIG. 14*a*) are severed one after the other from the material web 91. For this purpose, the severing turret 93 has retaining elements for the material web 91 and/or the individual blanks. These are holders 94 which are assigned to in each case one blank. These holders have suction elements 95, on the radially outwardly directed side, for gripping and retaining in each case one blank.

For the purpose of severing the blanks 69 from the material web 91, severing elements, namely severing rollers 96, 97, interact with the severing turret 93. These severing rollers are spaced apart from one another in a circumferential direction of the severing turret 33 by a distance corresponding to the width of a blank. The severing rollers 96, 97 each press blanks onto the holders 94. On account of different rotational speeds—the second severing roller 97 has a greater circumferential speed than the severing roller 96—the respectively front blank is severed from the material web 91 and then carried along by a holder 94.

The individual blanks 69 are transferred from the severing turret 93 to a following turret, namely to a first folding turret 98. The latter receives in each case one blank by way of a turret pocket 99. The folding steps which are illustrated in FIGS. 14*c*) to 14*f*) are carried out as the blanks are transported by way of this folding turret 98.

The thus largely folded blank 69 is then transferred from the first folding turret 98 to a second folding turret 100. During transfer, the outer side tabs 83, which are directed sideways, are folded over into abutment against the inner side tabs 84.

The folding turret 100 feeds the blanks 69, in the folding position according to FIG. 14*g*), to the pocket turret 53, which is positioned equiaxially with the mandrel turret 24. This pocket turret—in a manner analogous to the exemplary embodiment according to FIGS. 3 to 11—is provided with blank pockets 101, which can be displaced in the axis-parallel direction and, in a retracted, starting position, form a third operating plane.

The construction and functioning of the folding turrets 98 and 100 are only illustrated schematically in FIGS. 16, 17, 18 and 19. Folding steps are carried out, in particular, during transfer from one turret to the other. Thus, FIG. 16 shows that the blanks, which are flat in the region of the severing turret 93, are folded when they are received by a pocket 99 of the folding turret 98, to be precise lateral folding tabs are erected, in accordance with FIG. 14*c*), by lateral pocket walls 102. During this folding step, an initially radially outwardly moving pocket base 103 is moved radially inwards, that is to say into the turret pocket 99, as the folding operation progresses. In the axial direction, the turret pockets 99 are dimensioned such that regions of the lid and of the front wall 76 are not gripped (FIG. 14*c*)). During the conveying movement in the arrow direction according to FIG. 16, the base corner tabs 85, which are erected in a first folding step, are positioned transversely (FIG. 14*d*).

As the blanks 69 are transported by way of the first folding turret 98, known, stationary folding means are used first of all to erect a part of the blank comprising the base 77, front wall 76 and folding tabs which are connected thereto (FIG. 14*e*)), and then to fold this part of the blank into the position approximately parallel to the rear wall 78 (position shown in FIG. 14*f*)). The blank is then transferred to the second folding turret 100. During this transfer step, in turn, lateral tabs, namely the outer side tabs 83, are folded, to be precise into the position appropriate for the pack, this position being in accordance with FIG. 14*g*). Moveable, namely pivotable, pocket walls 104 take effect as the (folded) blanks are introduced into the blank pocket 101. These pocket walls are moved, during the step of transferring the blanks, from a spread-apart, outwardly diverging position relative to one another (FIGS. 17 and 18) into a closed, parallel position. The two side tabs 83 are folded one after the other in the process. In this largely completed formation of the blank according to FIG. 14*g*), the blank, with definitively folded box part 70, is transferred to the main turret, namely to the pocket turret 53.

It is also the case with this exemplary embodiment that the pocket turret 53 forms a turret unit with the mandrel turret 24. The pocket turret 53 is equipped with two axially offset retaining elements for the packs or folded blanks. In the (second) operating plane, pairs of retaining jaws 106 are provided for each blank. These retaining jaws grip the blanks, which are fed from the folding turret 100, in the folding position according to FIG. 14*g*), to be precise in the region of mutually opposite side walls of the box part 70 and lid 71. Pack pockets 107 are arranged on the circumference of the pocket turret 53, to be precise they are aligned in the axis-parallel direction in each case with a folding mandrel 25 of the adjacent mandrel turret 24. Pack pockets 107 and folding mandrels 25 are thus arranged on circular surfaces with the same diameter. The pack pockets 107 can be displaced in the axis-parallel direction, to be precise from a starting position (FIGS. 20 and 21), which corresponds to the third operating plane, into a position for receiving the folded blanks (second operating plane) corresponding to FIGS. 22 and 23. The folded blanks or (empty) packs here are held ready in the first instance by the retaining jaws 106 (FIGS. 20 and 21). The retaining jaws 106 are mounted in a pivotable manner, to be precise on comparatively long pivot arms 108, 109 which, taking account of the desired kinematics, are of different lengths and are mounted such that they can be pivoted approximately parallel to one another. A region of the pivot arms 108, 109 which is directed towards the blanks or packs, including the retaining jaws 106, is configured in a U-shaped manner to form an approximately central aperture 110.

As the blanks/packs are held ready in a position according to FIGS. 20 and 21, they are received by the pack pockets 107 by the latter being displaced in the axis-parallel direction. The pack pockets 107 comprise a radially inner base plate 111, finger-like side guides 112 and a radially outer top guide 113. The base plate 111 and top guide 113 are located opposite one another in the region of the (radially inner) rear wall 78, on the one hand, and of the radially outer front wall 76, on the other hand. The base plate 111 extends into the region of the lid rear wall 79, while the top guide 113 is of smaller dimensions. The side tabs 83, 84—which have not yet been connected to one another by adhesive bonding—are gripped by the side guide 112. The latter enters into a groove-like depression 114 of the two retaining jaws 106 as the pack pocket 107 is displaced. Once a pack or a blank has been received by a pack pocket 107, the retaining jaws 106 can be moved apart from one another to free the pack or the blank 69.

The operation of combining the two pack units then begins. For this purpose, the inner pack unit, to be precise including the collar 72, is pushed off from the folding mandrel 25 in the manner which has been described in conjunction with the exemplary embodiment according to FIGS. 3 to 11. Not yet folded parts of the lid 71, namely the lid rear wall 79, end wall 80 and lid front wall 81 with lid inner tab 82, have been deformed in the radially inward direction beforehand to form a funnel-like position (FIG. 23). Furthermore, lateral folding tabs, namely lid corner tabs 88, are likewise formed into an obliquely directed, funnel-like position (FIG. 22). The side tabs 83, 84, which have not yet been connected to one another by adhesive bonding, are displaced slightly in relation to one another, with the result that the box part 70 is open in a slightly funnel-like manner in the direction of the open side by oblique positioning of the front wall 76. The top wall or top guide 113 of the pack pockets 107 is beveled correspondingly on the inside. The cigarette block 10 can then be pushed into the pack by the pusher 59, to be precise part of it can be pushed in, namely such that an end region of the cigarette block is exposed (FIG. 24). Folding tabs of an end folding formation of the cigarette block 10 which are oriented in the axis-parallel direction, namely longitudinal folding tabs 63, can then be folded, as a result of continued rotary movement of the turrets, the end folding formation of the cigarette block 10 being completed in the process. The as yet non-folded part of the lid 71, namely the end wall 80 and lid front wall 81, are then folded into the closed position in accordance with FIG. 141). For this purpose, use is made of a stationary, rail-like folding element 115 with an angled profile (FIG. 26).

The box part 70 of the hinge-lid box is likewise completed, that is say folded from the funnel-like open position (FIG. 23) into the position appropriate for the pack, with full overlapping of the side tabs 83 and 84. Furthermore, the folding tabs which are to be connected to one another by glue are then connected to one another by the activation of corresponding areas of glue. For this purpose, during (industrial) production, the blanks 69, in the region of folding tabs which are to be connected to one another by glue, are provided with areas of glue which can be activated and/or reactivated by the action of heat and/or pressure or in some other way. For example, the relevant folding tabs may be provided with hot-melt glue. Following completion of the pack (FIG. 26), the relevant folding tabs are connected to one another by virtue of the areas of glue being activated.

The last-described folding steps are carried out with the pack pockets 107 retracted, that is to say in the third operating plane. In this position, the pack pockets 107 are spaced apart by a relatively large distance from the folding mandrels 25 (FIGS. 24 to 26). Furthermore, once the longitudinal folding tabs 63 have been folded, the cigarette block 10 is pushed all the way into the pack or into the box part 70 (FIG. 25). The lid 71 is then completed.

The finished packs are received by a removal conveyor 116 and transported away. The procedure here is such that the finished packs are passed back to the retaining jaws 106 by axis-parallel displacement of the pack pockets 107 into the position facing the folding mandrels 25 (central operating plane). By a correspondingly movement of the pivot arms 108, 109, the retaining jaws are moved against the sides of the pack pockets 107. By virtue of the pack pockets 107 being retracted into a position according to FIGS. 20 and 21, the finished packs are passed back to the retaining jaws 106. A star-like transfer conveyor 117 can then receive the packs 10, by entering into the aperture 110 of the retaining jaws 106, and feed them to the removal conveyor 116.

LIST OF DESIGNATIONS

| | |
|---|---|
| 10 | cigarette block |
| 11 | inner blank |
| 12 | cigarette group |
| 13 | slide |
| 14 | slide wall |
| 15 | side crosspiece |
| 16 | base flap |

-continued

| | |
|---|---|
| 17 | end flap |
| 18 | insertion flap |
| 19 | insertion flap |
| 20 | shell |
| 21 | front wall |
| 22 | rear wall |
| 23 | side wall |
| 24 | mandrel turret |
| 25 | folding mandrel |
| 26 | pocket chain |
| 27 | blank station |
| 28 | side wall |
| 29 | folding element |
| 30 | folding lever |
| 31 | folding leg |
| 32 | base folding formation |
| 33 | slide station |
| 34 | blank magazine |
| 35 | deflecting roller |
| 36 | counter-roller |
| 37 | side wall |
| 38 | conveying roller |
| 39 | pressure-exerting rollerab |
| 40 | lever |
| 41 | folding wheel |
| 42 | shell magazine |
| 43 | shell turret |
| 44 | intermediate turret |
| 45 | abutment surface |
| 46 | pocket |
| 47 | pocket wall |
| 48 | pocket wall |
| 49 | folding edge |
| 50 | folding edge |
| 51 | base |
| 52 | end holder |
| 53 | pocket turret |
| 54 | shell pocket |
| 55 | carrying component |
| 56 | carrying wall |
| 57 | outer wall |
| 58 | stop |
| 59 | pusher |
| 60 | steadying element |
| 61 | push rod |
| 62 | guide crosspiece |
| 63 | longitudinal folding tab |
| 64 | folding diverter |
| 65 | removal conveyor |
| 69 | blank |
| 70 | box part |
| 71 | lid |
| 72 | collar |
| 73 | collar front wall |
| 74 | collar tab |
| 75 | collar tab |
| 76 | front wall |
| 77 | base |
| 78 | rear wall |
| 79 | lid rear wall |
| 80 | end wall |
| 81 | lid front wall |
| 82 | lid inner tab |
| 83 | outer side tab |
| 84 | inner side tab |
| 85 | base corner tab |
| 86 | (outer) lid side tab |
| 87 | (inner) lid side tab |
| 88 | lid corner tab |
| 89 | collar station |
| 90 | collar conveyor |
| 91 | material web |
| 92 | monitoring element |
| 93 | severing turret |
| 94 | holder |
| 95 | suction element |
| 96 | severing roller |

-continued

| | |
|---|---|
| 97 | severing roller |
| 98 | holding turret |
| 99 | turret pocket |
| 100 | folding turret |
| 101 | blank pocket |
| 102 | pocket wall |
| 103 | pocket base |
| 104 | pocket wall |
| 105 | base holder |
| 106 | retaining jaw |
| 107 | pack pocket |
| 108 | pivot arm |
| 109 | pivot arm |
| 110 | aperture |
| 111 | base plate |
| 112 | side guide |
| 113 | top guide |
| 114 | depression |
| 115 | folding element |
| 116 | removal conveyor |
| 117 | transfer conveyor |

The invention claimed is:

1. An apparatus for producing hinge-lid boxes or shell and slide packs, comprising block-form pack contents in a form of a cigarette block (10) comprising a cigarette group (12) and an inner blank (11), and an outer wrapper made of cardboard, said apparatus comprising:

a) a mandrel turret having a plurality of folding mandrels (25), wherein each of the plurality of the folding mandrels has an axis parallel to the others, said folding mandrels being arranged along the circumference of the mandrel turret (24) for producing the cigarette block (10) and/or for producing an inner pack unit, and b) a pocket turret (53) arranged in an offset plane in relation to the mandrel turret (24) and having a plurality of shell pockets (54) or pack pockets (107) for accommodating an erected shell (20) or a blank (69) which has been partially folded to form a box part (70) which is open on one side, c) wherein the mandrel turret (24) and the pocket turret (53) move continuously and synchronously on a common shaft, d) each of the shell pockets (54) or pack pockets (107) of the pocket turret (53) being in alignment with an axis of a respective folding mandrel (25) of the mandrel turret (24) such that the inner pack unit is formed on the folding mandrel (25) and is pushed along said axis into said erected shell (20) held ready in the region of the pocket turret (53), or into the box part (70).

2. The apparatus as claimed in claim 1, characterized in that the inner pack unit, which is formed in the region of the folding mandrels (25) of the mandrel turret (24), is drawn off from the folding mandrel (25), and pushed into the shell (20) or the box part (70), by a pusher (59), which enters into the folding mandrel (25), the shell pockets (54) or pack pockets (107), for receiving the inner pack unit from the folding mandrel (25), being displaced in the axis-parallel direction, in order to reduce the distance from the associated folding mandrel (25).

3. The apparatus as claimed in claim 1, characterized in that, when the inner pack unit, which is formed on the folding mandrel (25), is pushed off from the folding mandrel (25), just a sub-region of it is pushed into the shell (20) or the box part (70), such that a sub-region of the inner pack unit is located outside the shell (20) or outside the box part (70), further folding being carried out on that part of the inner pack unit which projects out of the shell (20) or the box part (70), and then the finished inner pack unit being pushed all the way into the shell (20) or the box part (70).

4. The apparatus as claimed in claim 1, characterized in that a blank of a slide (13) or of a collar (72) is fed to the mandrel turret (24) in a downward or radial direction in the region of a slide station (33) or collar station (89), arranged above the mandrel turret (24), and is positioned, by way of a side crosspiece (15) or a collar tab (74), against a front side wall (28) of the folding mandrel (25), as seen in the direction of rotation of the mandrel turret (24), and in that, in two further folding steps, a slide wall (14) or a collar front wall (23) is folded onto a radially outer side of the folding mandrel (25) and a further side crosspiece (15) or a further collar tab (75) is folded onto a rear side wall (37) of the folding mandrel (25), by a rotating folding wheel (41).

5. The apparatus as claimed in claim 1, characterized in that prefabricated shells (20) of a shell and slide pack are transported in a collapsed position by way of a shell turret (43) and are erected as they are transferred to a following intermediate turret (44) by virtue of a front folding edge (49) of the shell (20), as seen in the conveying direction, coming into contact with a pocket or pocket wall (47) of the intermediate turret (44) and by virtue of pressure being transmitted to a diagonally opposite, rear folding edge (50).

6. The apparatus as claimed in claim 1, characterized in that erected shells (20), for producing shell and slide packs are accommodated in shell pockets (54) of the pocket turret (53), the shells (20) being positioned in the shell pocket (54), which is open in relation to the adjacent folding mandrel (25), by stops (58).

7. The apparatus as claimed in claim 6, characterized in that centrally within the shell pocket (54) is a steadying element (60) with a push rod (61), the inner pack unit pushing into the shell (20) and butting against the steadying element in a starting position such that a sub-region of the inner pack unit projects out of the shell (20).

8. The apparatus as claimed in claim 6, characterized in that the shell pocket (54) comprises a radially inner carrying wall (56) and an outer wall (57) located opposite, and in that lateral guide crosspieces (62) are positioned on the steadying element (60) for the purpose of fixing the side crosspieces (15) of the slide.

9. The apparatus as claimed in claim 1, characterized in that a part of the slide (13) comprising the end flap (17) and insertion flap (19) is folded, as the slide (13) projects part of the way out of the shell (20), by stationary folding elements, namely a folding diverter (64), as the pocket turret (53) rotates, and in that, following completion of folding, the slide (13) is pushed all the way into the shell (20), with the steadying element (60) being moved back at the same time.

10. The apparatus as claimed in claim 1, characterized in that, in order to produce hinge-lid boxes, blanks (69) are folded prior to transfer to the pocket turret (53) such that folding of the box part (70), without folding tabs being connected to one another, has been completed when the blank (69) is transferred to a pack pocket (107).

11. The apparatus as claimed in claim 10, characterized in that the pocket turret (53) has folding turrets arranged upstream of it, and in that further blank parts are folded upon transfer to a second folding turret (100).

12. The apparatus as claimed in claim 10, characterized in that, once the cigarette block (10), including collar (72), has been pushed off from the folding mandrel (25), just a sub-region of it is pushed into the open box part (70), and in that, as the pack pocket (107) is transported further, folding tabs (63) of the end wall of the cigarette block (10) and folding tabs (81/86) of the lid (71) are folded by a fixed folding element (115), the cigarette block (10) with collar (72) then being pushed all the way into the box part (70).

13. The apparatus as claimed in claim 1, characterized in that the blanks (69), which are folded in order to form the box part (70), are gripped, and are held ready in order to be received by the pack pockets (107), in a plane between the pocket turret (53) and the mandrel turret (24) by retaining jaws (106) which are positioned on pivot arms (108, 109) and each grip a folded blank (69) in the region of side walls or side tabs (83) of the box part (70).

14. The apparatus as claimed in claim 13, characterized in that the pack pockets (107), for receiving the partially folded blank (69), are displaced into the region of the retaining jaws (106) in the axis-parallel direction in relation to the adjacent folding mandrels (25), wherein, on account of the configuration of the retaining jaws (106) on the one hand and of the pack pockets (107) on the other hand, the blanks (69) are gripped by the pack pockets (107) with the retaining jaws (106) closed.

15. The apparatus as claimed in claim 14, characterized in that the pack pocket (107) comprises a base plate (111), a top guide (113) located opposite, and lateral crosspieces or finger-like side guides (112), the side guides (112), for receiving a blank (69) from the retaining jaws (106), entering into a depression (114) of the retaining jaw (106).

16. The apparatus as claimed in claim 15, characterized in that the base plate (111) and the top guide (113) of the pack pocket (107) are designed to diverge in the direction of the open side, by way of an obliquely running inner surface of the top guide (113), so as to provide a funnel-like open position of the box part (70) in the pack pocket (107).

* * * * *